US007243731B2

(12) United States Patent
Watson et al.

(10) Patent No.: US 7,243,731 B2
(45) Date of Patent: Jul. 17, 2007

(54) APPARATUS FOR RADIALLY EXPANDING TUBULAR MEMBERS INCLUDING A SEGMENTED EXPANSION CONE

(75) Inventors: Brock Wayne Watson, Carrollton, TX (US); Lev Ring, Houston, TX (US); David Paul Brisco, Duncan, OK (US)

(73) Assignee: Enventure Global Technology, Houston, TX (US)

( * ) Notice: Subject to any disclaimer, the term of this patent is extended or adjusted under 35 U.S.C. 154(b) by 349 days.

(21) Appl. No.: 10/487,199

(22) PCT Filed: Aug. 1, 2002

(86) PCT No.: PCT/US02/24399

§ 371 (c)(1),
(2), (4) Date: Feb. 19, 2004

(87) PCT Pub. No.: WO03/016669

PCT Pub. Date: Feb. 27, 2003

(65) Prior Publication Data

US 2005/0028987 A1 Feb. 10, 2005

Related U.S. Application Data

(60) Provisional application No. 60/313,453, filed on Aug. 20, 2001.

(51) Int. Cl.
*E21B 23/04* (2006.01)
*E21B 43/10* (2006.01)
*B21D 41/02* (2006.01)

(52) U.S. Cl. ..... 166/380; 166/382; 166/207; 166/212; 72/370.08; 72/393

(58) Field of Classification Search ..... 166/380, 166/382, 207, 209, 212, 216
See application file for complete search history.

(56) References Cited

U.S. PATENT DOCUMENTS

| | | | | |
|---|---|---|---|---|
| 802,880 | A | 10/1905 | Phillips, Jr. | |
| 1,166,040 | A | 12/1915 | Burlingham | |
| 1,494,128 | A * | 5/1924 | Primrose | 72/370.08 |
| 1,590,280 | A * | 6/1926 | Buchanan | 294/102.1 |
| 1,597,212 | A | 10/1926 | Spengler | |
| 1,613,461 | A | 1/1927 | Johnson | |
| 1,756,531 | A | 4/1930 | Aldeen et al. | |
| 2,145,168 | A | 1/1939 | Flagg | |

(Continued)

FOREIGN PATENT DOCUMENTS

| | | |
|---|---|---|
| AU | 767364 | 2/2004 |

(Continued)

OTHER PUBLICATIONS

Letter From Baker Oil Tools to William Norvell in Regards to Enventure's Claims of Baker Infringement Of Enventure's Expandable Patents Apr. 1, 2005.

(Continued)

*Primary Examiner*—Kenneth Thompson
(74) *Attorney, Agent, or Firm*—Haynes and Boone LLP; Todd Mattingly

(57) ABSTRACT

An apparatus for radially expanding tubular members including a segmented expansion cone.

23 Claims, 14 Drawing Sheets

U.S. PATENT DOCUMENTS

| | | | | |
|---|---|---|---|---|
| 2,371,840 | A | | 3/1945 | Otis |
| 2,383,214 | A | | 8/1945 | Prout |
| 2,546,295 | A | | 3/1951 | Boice |
| 2,627,891 | A | | 2/1953 | Clark |
| 2,877,822 | A | * | 3/1959 | Buck ..... 72/453.05 |
| 2,929,741 | A | | 1/1960 | Strock et al. |
| 3,015,362 | A | | 1/1962 | Moosman |
| 3,067,801 | A | * | 12/1962 | Sortor ..... 29/522.1 |
| 3,068,563 | A | | 12/1962 | Reverman |
| 3,210,102 | A | | 10/1965 | Joslin |
| 3,233,315 | A | | 2/1966 | Levake |
| 3,343,252 | A | | 9/1967 | Reesor |
| 3,371,717 | A | | 3/1968 | Chenoweth |
| 3,427,707 | A | | 2/1969 | Nowosadko |
| 3,520,049 | A | | 7/1970 | Lysenko et al. |
| 3,528,498 | A | | 9/1970 | Carothers |
| 3,532,174 | A | * | 10/1970 | Hinks et al. ..... 175/56 |
| 3,578,081 | A | | 5/1971 | Bodine |
| 3,605,887 | A | | 9/1971 | Lambie |
| 3,667,547 | A | | 6/1972 | Ahlstone |
| 3,709,306 | A | | 1/1973 | Curington |
| 3,781,966 | A | | 1/1974 | Lieberman |
| 3,942,824 | A | | 3/1976 | Sable |
| 4,019,579 | A | | 4/1977 | Thuse |
| 4,069,573 | A | | 1/1978 | Rogers, Jr. et al. |
| 4,076,287 | A | | 2/1978 | Bill et al. |
| 4,125,937 | A | | 11/1978 | Brown et al. |
| 4,168,747 | A | | 9/1979 | Youmans |
| 4,204,312 | A | | 5/1980 | Tooker |
| 4,226,449 | A | | 10/1980 | Cole |
| 4,253,687 | A | | 3/1981 | Maples |
| 4,257,155 | A | | 3/1981 | Hunter |
| 4,328,983 | A | | 5/1982 | Gibson |
| 4,355,664 | A | | 10/1982 | Cook et al. |
| 4,384,625 | A | | 5/1983 | Roper et al. |
| 4,401,325 | A | | 8/1983 | Tsuchiya et al. |
| 4,422,507 | A | | 12/1983 | Reimert |
| 4,442,586 | A | | 4/1984 | Ridenour |
| 4,449,713 | A | | 5/1984 | Ishido et al. |
| 4,467,630 | A | | 8/1984 | Kelly |
| 4,468,309 | A | | 8/1984 | White |
| 4,469,356 | A | | 9/1984 | Duret et al. |
| 4,491,001 | A | | 1/1985 | Yoshida |
| 4,505,987 | A | | 3/1985 | Yamada et al. |
| 4,507,019 | A | | 3/1985 | Thompson |
| 4,526,839 | A | | 7/1985 | Herman et al. |
| 4,530,231 | A | | 7/1985 | Main |
| 4,541,655 | A | | 9/1985 | Hunter |
| 4,550,782 | A | | 11/1985 | Lawson |
| 4,595,063 | A | | 6/1986 | Jennings et al. |
| 4,601,343 | A | | 7/1986 | Lindsey, Jr. et al. |
| 4,614,233 | A | | 9/1986 | Menard |
| 4,649,492 | A | | 3/1987 | Sinha et al. |
| 4,651,836 | A | | 3/1987 | Richards |
| 4,674,572 | A | | 6/1987 | Gallus |
| 4,754,781 | A | | 7/1988 | Putter |
| 4,758,025 | A | | 7/1988 | Frick |
| 4,778,088 | A | | 10/1988 | Miller |
| 4,779,445 | A | | 10/1988 | Rabe |
| 4,817,712 | A | | 4/1989 | Bodine |
| 4,832,382 | A | | 5/1989 | Kapgan |
| 4,836,579 | A | | 6/1989 | Wester et al. |
| 4,842,082 | A | | 6/1989 | Springer |
| 4,848,459 | A | | 7/1989 | Blackwell et al. |
| 4,854,338 | A | | 8/1989 | Grantham |
| 4,856,592 | A | | 8/1989 | Van Bilderbeek et al. |
| 4,904,136 | A | | 2/1990 | Matsumoto |
| 4,915,177 | A | | 4/1990 | Claycomb |
| 4,915,426 | A | | 4/1990 | Skipper |
| 4,917,409 | A | | 4/1990 | Reeves |
| 4,919,989 | A | | 4/1990 | Colangelo |
| 4,930,573 | A | | 6/1990 | Lane et al. |
| 4,934,038 | A | * | 6/1990 | Caudill ..... 29/523 |
| 4,938,291 | A | | 7/1990 | Lynde et al. |
| 4,942,925 | A | | 7/1990 | Themig |
| 4,995,464 | A | | 2/1991 | Watkins et al. |
| 5,031,370 | A | | 7/1991 | Jewett |
| 5,064,004 | A | | 11/1991 | Lundel |
| 5,134,891 | A | | 8/1992 | Canevet |
| 5,150,755 | A | | 9/1992 | Cassel et al. |
| 5,156,213 | A | | 10/1992 | George et al. |
| 5,195,583 | A | | 3/1993 | Toon et al. |
| 5,242,017 | A | | 9/1993 | Hailey |
| 5,275,242 | A | | 1/1994 | Payne |
| 5,282,508 | A | | 2/1994 | Ellingsen et al. |
| 5,306,101 | A | | 4/1994 | Rockower et al. |
| 5,314,014 | A | | 5/1994 | Tucker |
| 5,326,137 | A | | 7/1994 | Lorenz et al. |
| 5,327,964 | A | | 7/1994 | O'Donnell et al. |
| 5,337,827 | A | | 8/1994 | Hromas et al. |
| 5,360,239 | A | | 11/1994 | Klementich |
| 5,400,827 | A | | 3/1995 | Baro et al. |
| 5,413,180 | A | | 5/1995 | Ross et al. |
| 5,431,831 | A | | 7/1995 | Vincent |
| 5,456,319 | A | | 10/1995 | Schmidt et al. |
| 5,458,194 | A | | 10/1995 | Brooks |
| 5,492,173 | A | | 2/1996 | Kilgore et al. |
| 5,554,244 | A | | 9/1996 | Ruggles et al. |
| 5,566,772 | A | | 10/1996 | Coone et al. |
| 5,584,512 | A | | 12/1996 | Carstensen |
| 5,662,180 | A | | 9/1997 | Coffman et al. |
| 5,697,449 | A | | 12/1997 | Hennig et al. |
| 5,738,146 | A | | 4/1998 | Abe |
| 5,743,335 | A | | 4/1998 | Bussear |
| 5,749,419 | A | | 5/1998 | Coronado et al. |
| 5,749,585 | A | | 5/1998 | Lembcke |
| 5,862,866 | A | | 1/1999 | Springer |
| 5,895,079 | A | | 4/1999 | Carstensen et al. |
| 5,944,108 | A | | 8/1999 | Baugh et al. |
| 5,975,587 | A | | 11/1999 | Wood et al. |
| 6,012,521 | A | | 1/2000 | Zunkel et al. |
| 6,056,324 | A | | 5/2000 | Reimert et al. |
| 6,073,692 | A | | 6/2000 | Wood et al. |
| 6,138,761 | A | | 10/2000 | Freeman et al. |
| 6,158,963 | A | | 12/2000 | Hollis |
| 6,263,966 | B1 | | 7/2001 | Haut et al. |
| 6,318,457 | B1 | | 11/2001 | Den Boer et al. |
| 6,318,465 | B1 | | 11/2001 | Coon et al. |
| 6,343,495 | B1 | | 2/2002 | Cheppe et al. |
| 6,343,657 | B1 | | 2/2002 | Baugh et al. |
| 6,345,373 | B1 | | 2/2002 | Chakradhar et al. |
| 6,352,112 | B1 | | 3/2002 | Mills |
| 6,390,720 | B1 | | 5/2002 | LeBegue et al. |
| 6,406,063 | B1 | | 6/2002 | Pfeiffer |
| 6,419,025 | B1 | | 7/2002 | Lohbeck et al. |
| 6,419,026 | B1 | | 7/2002 | MacKenzie et al. |
| 6,431,277 | B1 | | 8/2002 | Cox et al. |
| 6,450,261 | B1 | | 9/2002 | Baugh |
| 6,464,008 | B1 | | 10/2002 | Roddy et al. |
| 6,464,014 | B1 | | 10/2002 | Bernat |
| 6,470,996 | B1 | | 10/2002 | Kyle et al. |
| 6,478,092 | B2 | | 11/2002 | Voll et al. |
| 6,491,108 | B1 | | 12/2002 | Slup et al. |
| 6,516,887 | B2 | | 2/2003 | Nguyen et al. |
| 6,543,545 | B1 | | 4/2003 | Chatterji et al. |
| 6,543,552 | B1 | | 4/2003 | Metcalfe et al. |
| 6,550,539 | B2 | | 4/2003 | Maguire et al. |
| 6,561,279 | B2 | | 5/2003 | MacKenzie et al. |
| 6,568,488 | B2 | | 5/2003 | Wentworth et al. |
| 6,591,905 | B2 | | 7/2003 | Coon |
| 6,598,677 | B1 | | 7/2003 | Baugh et al. |
| 6,598,678 | B1 | | 7/2003 | Simpson |
| 6,607,220 | B2 | | 8/2003 | Sivley, IV |
| 6,622,797 | B2 | | 9/2003 | Sivley, IV |

6,629,567 B2 10/2003 Lauritzen et al.
6,631,765 B2 10/2003 Baugh et al.
6,640,895 B2 11/2003 Murray
6,648,075 B2 11/2003 Badrak et al.
6,672,759 B2 1/2004 Feger
6,679,328 B2 1/2004 Davis et al.
6,681,862 B2 1/2004 Freeman
6,684,947 B2 2/2004 Cook et al.
6,688,397 B2 2/2004 McClurkin et al.
6,695,012 B1 2/2004 Ring et al.
6,695,065 B2 2/2004 Simpson et al.
6,698,517 B2 3/2004 Simpson
6,701,598 B2 3/2004 Chen et al.
6,702,030 B2 3/2004 Simpson
6,705,395 B2 3/2004 Cook et al.
6,708,767 B2 3/2004 Harrall et al.
6,712,154 B2 3/2004 Cook et al.
6,712,401 B2 3/2004 Coulon et al.
6,719,064 B2 4/2004 Price-Smith et al.
6,722,427 B2 4/2004 Gano et al.
6,722,437 B2 4/2004 Vercaemer et al.
6,722,443 B1 4/2004 Metcalfe
6,725,919 B2 4/2004 Cook et al.
6,725,934 B2 4/2004 Coronado et al.
6,725,939 B2 4/2004 Richard
6,732,806 B2 5/2004 Mauldin et al.
6,739,392 B2 5/2004 Cook et al.
6,745,845 B2 6/2004 Cook et al.
6,758,278 B2 7/2004 Cook et al.
6,796,380 B2 9/2004 Xu
6,814,147 B2 11/2004 Baugh
6,820,690 B2 11/2004 Vercaemer et al.
6,823,937 B1 11/2004 Cook et al.
6,832,649 B2 12/2004 Bode et al.
6,834,725 B2 12/2004 Whanger et al.
6,843,322 B2 1/2005 Burtner et al.
6,857,473 B2 2/2005 Cook et al.
6,880,632 B2 * 4/2005 Tom et al. ..... 166/217
6,892,819 B2 5/2005 Cook et al.
6,902,000 B2 6/2005 Simpson et al.
6,907,652 B1 6/2005 Heijnen
2001/0045284 A1 11/2001 Simpson et al.
2001/0045289 A1 11/2001 Cook et al.
2002/0020531 A1 2/2002 Ohmer
2002/0033261 A1 3/2002 Metcalfe
2002/0060068 A1 5/2002 Cook et al.
2003/0034177 A1 2/2003 Chitwood et al.
2003/0042022 A1 3/2003 Lauritzen et al.
2003/0067166 A1 4/2003 Maguire
2003/0150608 A1 * 8/2003 Smith, Jr. et al. ..... 166/118
2003/0168222 A1 9/2003 Maguire et al.
2004/0011534 A1 1/2004 Simonds et al.
2004/0045616 A1 3/2004 Cook et al.
2004/0045718 A1 3/2004 Brisco et al.
2004/0060706 A1 4/2004 Stephenson
2004/0065446 A1 4/2004 Tran et al.
2004/0069499 A1 4/2004 Cook et al.
2004/0112589 A1 6/2004 Cook et al.
2004/0112606 A1 6/2004 Lewis et al.
2004/0118574 A1 6/2004 Cook et al.
2004/0123983 A1 7/2004 Cook et al.
2004/0123988 A1 7/2004 Cook et al.
2004/0129431 A1 7/2004 Jackson
2004/0159446 A1 8/2004 Haugen et al.
2004/0188099 A1 9/2004 Cook et al.
2004/0216873 A1 11/2004 Frost, Jr. et al.
2004/0221996 A1 11/2004 Burge
2004/0231839 A1 11/2004 Ellington et al.
2004/0231855 A1 11/2004 Cook et al.
2004/0238181 A1 12/2004 Cook et al.
2004/0244968 A1 12/2004 Cook et al.
2004/0262014 A1 12/2004 Cook et al.
2005/0011641 A1 1/2005 Cook et al.
2005/0015963 A1 1/2005 Costa et al.
2005/0028988 A1 2/2005 Cook et al.
2005/0039910 A1 2/2005 Lohbeck
2005/0039928 A1 2/2005 Cook et al.
2005/0045324 A1 3/2005 Cook et al.
2005/0045341 A1 3/2005 Cook et al.
2005/0045342 A1 3/2005 Luke et al.
2005/0056433 A1 3/2005 Watson et al.
2005/0056434 A1 3/2005 Ring et al.
2005/0077051 A1 4/2005 Cook et al.
2005/0081358 A1 4/2005 Cook et al.
2005/0087337 A1 4/2005 Brisco et al.
2005/0098323 A1 5/2005 Cook et al.
2005/0103502 A1 5/2005 Watson et al.
2005/0123639 A1 6/2005 Ring et al.
2005/0133225 A1 6/2005 Oosterling
2005/0138790 A1 6/2005 Cook et al.
2005/0144771 A1 7/2005 Cook et al.
2005/0144772 A1 7/2005 Cook et al.
2005/0144777 A1 7/2005 Cook et al.
2005/0150098 A1 7/2005 Cook et al.
2005/0150660 A1 7/2005 Cook et al.
2005/0161228 A1 7/2005 Cook et al.
2005/0166387 A1 8/2005 Cook et al.
2005/0166388 A1 8/2005 Cook et al.
2005/0173108 A1 8/2005 Cook et al.
2005/0175473 A1 8/2005 Cook et al.
2005/0183863 A1 8/2005 Cook et al.
2005/0205253 A1 9/2005 Cook et al.
2005/0217866 A1 10/2005 Watson et al.

FOREIGN PATENT DOCUMENTS

AU 770008 7/2004
AU 770359 7/2004
AU 771884 8/2004
AU 776580 1/2005
CA 736288 6/1966
CA 771462 11/1967
CA 1171310 7/1984
CA 2292171 6/2000
CA 2298139 8/2000
CA 2234386 3/2003
DE 174521 4/1953
DE 2458188 6/1975
DE 203767 11/1983
DE 233607 A1 3/1986
DE 278517 A1 5/1990
EP 0084940 A1 8/1983
EP 0272511 12/1987
EP 0294264 5/1988
EP 0553566 A1 12/1992
EP 0633391 A2 1/1995
EP 0713953 B1 11/1995
EP 0823534 2/1998
EP 0881354 12/1998
EP 0881359 12/1998
EP 0899420 3/1999
EP 0937861 8/1999
EP 0952305 10/1999
EP 0952306 10/1999
EP 1141515 A 10/2001
EP 1152120 A2 11/2001
EP 1152120 A3 11/2001
EP 1235972 A 9/2002
EP 1555386 A1 7/2005
FR 1325596 6/1962
FR 2583398 A1 * 12/1986
FR 2717855 A1 9/1995
FR 2741907 A1 6/1997
FR 2771133 A 5/1999
FR 2780751 1/2000
FR 2841626 A1 1/2004

| | | | |
|---|---|---|---|
| GB | 788150 | | 12/1957 |
| GB | 851096 | | 10/1960 |
| GB | 1000383 | | 10/1965 |
| GB | 2257184 | A | 6/1993 |
| GB | 2368865 | A | 7/2000 |
| GB | 2361724 | | 10/2001 |
| GB | 2370301 | A | 6/2002 |
| GB | 2371064 | A | 7/2002 |
| GB | 2371574 | A | 7/2002 |
| GB | 2373524 | | 9/2002 |
| GB | 2374622 | A | 10/2002 |
| GB | 2375560 | A | 11/2002 |
| GB | 2380213 | A | 4/2003 |
| GB | 2380503 | A | 4/2003 |
| GB | 2381019 | A | 4/2003 |
| GB | 2382828 | A | 6/2003 |
| GB | 2380213 | B | 8/2003 |
| GB | 2380214 | B | 8/2003 |
| GB | 2380215 | B | 8/2003 |
| GB | 2384800 | B | 10/2003 |
| GB | 2384801 | B | 10/2003 |
| GB | 2384802 | B | 10/2003 |
| GB | 2384803 | B | 10/2003 |
| GB | 2384804 | B | 10/2003 |
| GB | 2384805 | B | 10/2003 |
| GB | 2384806 | B | 10/2003 |
| GB | 2384807 | B | 10/2003 |
| GB | 2384808 | B | 10/2003 |
| GB | 2385353 | B | 10/2003 |
| GB | 2385354 | B | 10/2003 |
| GB | 2385355 | B | 10/2003 |
| GB | 2385356 | B | 10/2003 |
| GB | 2385357 | B | 10/2003 |
| GB | 2385358 | B | 10/2003 |
| GB | 2385359 | B | 10/2003 |
| GB | 2385360 | B | 10/2003 |
| GB | 2385361 | B | 10/2003 |
| GB | 2385362 | B | 10/2003 |
| GB | 2385363 | B | 10/2003 |
| GB | 2385619 | B | 10/2003 |
| GB | 2385620 | B | 10/2003 |
| GB | 2385621 | B | 10/2003 |
| GB | 2385622 | B | 10/2003 |
| GB | 2385623 | B | 10/2003 |
| GB | 2387405 | A | 10/2003 |
| GB | 2388134 | A | 11/2003 |
| GB | 2388860 | A | 11/2003 |
| GB | 2355738 | B | 12/2003 |
| GB | 2374622 | B | 12/2003 |
| GB | 2388391 | B | 12/2003 |
| GB | 2388392 | B | 12/2003 |
| GB | 2388393 | B | 12/2003 |
| GB | 2388394 | B | 12/2003 |
| GB | 2388395 | B | 12/2003 |
| GB | 2356651 | B | 2/2004 |
| GB | 2368865 | B | 2/2004 |
| GB | 2388860 | B | 2/2004 |
| GB | 2388861 | B | 2/2004 |
| GB | 2388862 | B | 2/2004 |
| GB | 2390628 | B | 3/2004 |
| GB | 2391033 | B | 3/2004 |
| GB | 2392686 | A | 3/2004 |
| GB | 2373524 | B | 4/2004 |
| GB | 2390387 | B | 4/2004 |
| GB | 2392686 | B | 4/2004 |
| GB | 2392691 | B | 4/2004 |
| GB | 2391575 | B | 5/2004 |
| GB | 2394979 | A | 5/2004 |
| GB | 2395506 | A | 5/2004 |
| GB | 2392932 | B | 6/2004 |
| GB | 2396635 | A | 6/2004 |
| GB | 2396640 | A | 6/2004 |
| GB | 2396641 | A | 6/2004 |
| GB | 2396642 | A | 6/2004 |
| GB | 2396643 | A | 6/2004 |
| GB | 2396644 | A | 6/2004 |
| GB | 2373468 | B | 7/2004 |
| GB | 2397261 | A | 7/2004 |
| GB | 2397262 | A | 7/2004 |
| GB | 2397263 | A | 7/2004 |
| GB | 2397264 | A | 7/2004 |
| GB | 2397265 | A | 7/2004 |
| GB | 2390622 | B | 8/2004 |
| GB | 2398317 | A | 8/2004 |
| GB | 2398318 | A | 8/2004 |
| GB | 2398319 | A | 8/2004 |
| GB | 2398320 | A | 8/2004 |
| GB | 2398321 | A | 8/2004 |
| GB | 2398322 | A | 8/2004 |
| GB | 2398323 | A | 8/2004 |
| GB | 2382367 | B | 9/2004 |
| GB | 2396643 | B | 9/2004 |
| GB | 2397261 | B | 9/2004 |
| GB | 2397262 | B | 9/2004 |
| GB | 2397263 | B | 9/2004 |
| GB | 2397264 | B | 9/2004 |
| GB | 2397265 | B | 9/2004 |
| GB | 2399120 | A | 9/2004 |
| GB | 2399579 | A | 9/2004 |
| GB | 2399580 | A | 9/2004 |
| GB | 2399848 | A | 9/2004 |
| GB | 2399849 | A | 9/2004 |
| GB | 2399850 | A | 9/2004 |
| GB | 2384502 | B | 10/2004 |
| GB | 2396644 | B | 10/2004 |
| GB | 2400126 | A | 10/2004 |
| GB | 2400624 | A | 10/2004 |
| GB | 2396640 | B | 11/2004 |
| GB | 2396642 | B | 11/2004 |
| GB | 2401136 | A | 11/2004 |
| GB | 2401137 | A | 11/2004 |
| GB | 2401138 | A | 11/2004 |
| GB | 2401630 | A | 11/2004 |
| GB | 2401631 | A | 11/2004 |
| GB | 2401632 | A | 11/2004 |
| GB | 2401633 | A | 11/2004 |
| GB | 2401634 | A | 11/2004 |
| GB | 2401635 | A | 11/2004 |
| GB | 2401636 | A | 11/2004 |
| GB | 2401637 | A | 11/2004 |
| GB | 2401638 | A | 11/2004 |
| GB | 2401639 | A | 11/2004 |
| GB | 2381019 | B | 12/2004 |
| GB | 2382368 | B | 12/2004 |
| GB | 2401136 | B | 12/2004 |
| GB | 2401137 | B | 12/2004 |
| GB | 2401138 | B | 12/2004 |
| GB | 2403970 | A | 1/2005 |
| GB | 2403971 | A | 1/2005 |
| GB | 2403972 | A | 1/2005 |
| GB | 2400624 | B | 2/2005 |
| GB | 2404676 | A | 2/2005 |
| GB | 2388134 | B | 3/2005 |
| GB | 2398320 | B | 3/2005 |
| GB | 2398323 | B | 3/2005 |
| GB | 2399120 | B | 3/2005 |
| GB | 2399848 | B | 3/2005 |
| GB | 2399849 | B | 3/2005 |
| GB | 2405893 | A | 3/2005 |
| GB | 2406117 | A | 3/2005 |
| GB | 2406118 | A | 3/2005 |
| GB | 2406119 | A | 3/2005 |
| GB | 2406120 | A | 3/2005 |
| GB | 2406125 | A | 3/2005 |
| GB | 2406126 | A | 3/2005 |
| GB | 2389597 | B | 5/2005 |

| | | | |
|---|---|---|---|
| GB | 2399119 | B | 5/2005 |
| GB | 2399580 | B | 5/2005 |
| GB | 2401630 | B | 5/2005 |
| GB | 2401631 | B | 5/2005 |
| GB | 2401632 | B | 5/2005 |
| GB | 2401633 | B | 5/2005 |
| GB | 2401634 | B | 5/2005 |
| GB | 2401635 | B | 5/2005 |
| GB | 2401636 | B | 5/2005 |
| GB | 2401637 | B | 5/2005 |
| GB | 2401638 | B | 5/2005 |
| GB | 2401639 | B | 5/2005 |
| GB | 2408277 | A | 5/2005 |
| GB | 2408278 | A | 5/2005 |
| GB | 2399579 | B | 6/2005 |
| GB | 2409216 | A | 6/2005 |
| GB | 2409218 | A | 6/2005 |
| GB | 2401893 | B | 7/2005 |
| GB | 2 403970 | B | 8/2005 |
| GB | 2398326 | B | 8/2005 |
| GB | 2403971 | B | 8/2005 |
| GB | 2403972 | B | 8/2005 |
| GB | 2412681 | A | 10/2005 |
| GB | 2412682 | A | 10/2005 |
| JP | 208458 | | 10/1985 |
| JP | 6475715 | | 3/1989 |
| JP | 102875 | | 4/1995 |
| JP | 11-169975 | | 6/1999 |
| JP | 94068 | A | 4/2000 |
| JP | 107870 | A | 4/2000 |
| JP | 162192 | | 6/2000 |
| NL | 9001081 | | 12/1991 |
| RO | 113267 | B1 | 5/1998 |
| RU | 2016345 | C1 | 7/1994 |
| RU | 2039214 | C1 | 7/1995 |
| RU | 2056201 | C1 | 3/1996 |
| RU | 2064357 | C1 | 7/1996 |
| RU | 2068940 | C1 | 11/1996 |
| RU | 2068943 | C1 | 11/1996 |
| RU | 2079633 | C1 | 5/1997 |
| RU | 2083798 | C1 | 7/1997 |
| RU | 2091655 | C1 | 9/1997 |
| RU | 2095179 | C1 | 11/1997 |
| RU | 2105128 | C1 | 2/1998 |
| RU | 2108445 | C1 | 4/1998 |
| RU | 2144128 | C1 | 1/2000 |
| SU | 350833 | | 9/1972 |
| SU | 511468 | | 9/1976 |
| SU | 607950 | | 5/1978 |
| SU | 612004 | | 5/1978 |
| SU | 620582 | | 7/1978 |
| SU | 641070 | | 1/1979 |
| SU | 909114 | | 5/1979 |
| SU | 832049 | | 5/1981 |
| SU | 853089 | | 8/1981 |
| SU | 874952 | | 10/1981 |
| SU | 894169 | | 1/1982 |
| SU | 899850 | | 1/1982 |
| SU | 907220 | | 2/1982 |
| SU | 953172 | | 8/1982 |
| SU | 959878 | | 9/1982 |
| SU | 976019 | | 11/1982 |
| SU | 976020 | | 11/1982 |
| SU | 989038 | | 1/1983 |
| SU | 1002514 | | 3/1983 |
| SU | 1041671 | A | 9/1983 |
| SU | 1051222 | A | 10/1983 |
| SU | 1086118 | A | 4/1984 |
| SU | 1077803 | A | 7/1984 |
| SU | 1158400 | A | 5/1985 |
| SU | 1212575 | A | 2/1986 |
| SU | 1250637 | A1 | 8/1986 |
| SU | 1324722 | A1 | 7/1987 |
| SU | 1411434 | | 7/1988 |
| SU | 1430498 | A1 | 10/1988 |
| SU | 1432190 | A1 | 10/1988 |
| SU | 1601330 | A1 | 10/1990 |
| SU | 1627663 | A2 | 2/1991 |
| SU | 1659621 | A1 | 6/1991 |
| SU | 1663179 | A2 | 7/1991 |
| SU | 1663180 | A1 | 7/1991 |
| SU | 1677225 | A1 | 9/1991 |
| SU | 1677248 | A1 | 9/1991 |
| SU | 1686123 | A1 | 10/1991 |
| SU | 1686124 | A1 | 10/1991 |
| SU | 1686125 | A1 | 10/1991 |
| SU | 1698413 | A1 | 12/1991 |
| SU | 1710694 | A | 2/1992 |
| SU | 1730429 | A1 | 4/1992 |
| SU | 1745873 | A1 | 7/1992 |
| SU | 1747673 | A1 | 7/1992 |
| SU | 1749267 | A1 | 7/1992 |
| SU | 1786241 | A1 | 1/1993 |
| SU | 1804543 | A3 | 3/1993 |
| SU | 1810482 | A1 | 4/1993 |
| SU | 1818459 | A1 | 5/1993 |
| SU | 1295799 | A1 | 2/1995 |
| WO | WO81/00132 | | 1/1981 |
| WO | WO90/05598 | | 3/1990 |
| WO | WO92/01859 | | 2/1992 |
| WO | WO92/08875 | | 5/1992 |
| WO | WO93/25799 | | 12/1993 |
| WO | WO93/25800 | | 12/1993 |
| WO | WO94/21887 | | 9/1994 |
| WO | WO94/25655 | | 11/1994 |
| WO | WO95/03476 | | 2/1995 |
| WO | WO96/01937 | | 1/1996 |
| WO | WO96/21083 | | 7/1996 |
| WO | WO96/26350 | | 8/1996 |
| WO | WO96/37681 | | 11/1996 |
| WO | WO97/06346 | | 2/1997 |
| WO | WO97/11306 | | 3/1997 |
| WO | WO97/17524 | | 5/1997 |
| WO | WO97/17526 | | 5/1997 |
| WO | WO97/17527 | | 5/1997 |
| WO | WO97/20130 | | 6/1997 |
| WO | WO97/21901 | | 6/1997 |
| WO | WO97/35084 | | 9/1997 |
| WO | WO98/00626 | | 1/1998 |
| WO | WO98/07957 | | 2/1998 |
| WO | WO98/09053 | | 3/1998 |
| WO | WO98/22690 | | 5/1998 |
| WO | WO98/26152 | | 6/1998 |
| WO | WO98/42947 | | 10/1998 |
| WO | WO98/49423 | | 11/1998 |
| WO | WO99/02818 | | 1/1999 |
| WO | WO99/04135 | | 1/1999 |
| WO | WO99/06670 | | 2/1999 |
| WO | WO99/08827 | | 2/1999 |
| WO | WO99/08828 | | 2/1999 |
| WO | WO99/18328 | | 4/1999 |
| WO | WO99/23354 | | 5/1999 |
| WO | WO99/25524 | | 5/1999 |
| WO | WO99/25951 | | 5/1999 |
| WO | WO99/35368 | | 7/1999 |
| WO | WO99/43923 | | 9/1999 |
| WO | WO00/01926 | | 1/2000 |
| WO | WO00/04271 | | 1/2000 |
| WO | WO00/08301 | | 2/2000 |
| WO | WO00/26500 | | 5/2000 |
| WO | WO00/26501 | | 5/2000 |
| WO | WO00/26502 | | 5/2000 |
| WO | WO00/31375 | | 6/2000 |
| WO | WO00/37766 | | 6/2000 |
| WO | WO00/37767 | | 6/2000 |
| WO | WO00/37768 | | 6/2000 |

| | | | |
|---|---|---|---|
| WO | WO00/37771 | | 6/2000 |
| WO | WO00/37772 | | 6/2000 |
| WO | WO00/39432 | | 7/2000 |
| WO | WO00/46484 | | 8/2000 |
| WO | WO00/50727 | | 8/2000 |
| WO | WO00/50732 | | 8/2000 |
| WO | WO00/50733 | | 8/2000 |
| WO | WO00/77431 | A2 | 12/2000 |
| WO | WO01/04520 | A1 | 1/2001 |
| WO | WO01/04535 | A1 | 1/2001 |
| WO | WO01/18354 | A1 | 3/2001 |
| WO | WO01/21929 | A1 | 3/2001 |
| WO | WO01/26860 | A1 | 4/2001 |
| WO | WO01/33037 | A1 | 5/2001 |
| WO | WO01/38693 | A1 | 5/2001 |
| WO | WO01/60545 | A1 | 8/2001 |
| WO | WO01/83943 | A1 | 11/2001 |
| WO | WO01/98623 | A1 | 12/2001 |
| WO | WO02/01102 | A1 | 1/2002 |
| WO | WO02/10550 | A1 | 2/2002 |
| WO | WO02/10551 | A1 | 2/2002 |
| WO | WO 02/20941 | A1 | 3/2002 |
| WO | WO02/25059 | A1 | 3/2002 |
| WO | WO02/29199 | A1 | 4/2002 |
| WO | WO02/40825 | A1 | 5/2002 |
| WO | WO02/095181 | A1 | 5/2002 |
| WO | WO02/053867 | A2 | 7/2002 |
| WO | WO02/053867 | A3 | 7/2002 |
| WO | WO02/059456 | A1 | 8/2002 |
| WO | WO02/066783 | A1 | 8/2002 |
| WO | WO02/068792 | A1 | 9/2002 |
| WO | WO02/075107 | A1 | 9/2002 |
| WO | WO02/077411 | A1 | 10/2002 |
| WO | WO02/081863 | A1 | 10/2002 |
| WO | WO02/081864 | A2 | 10/2002 |
| WO | WO02/086285 | A1 | 10/2002 |
| WO | WO02/086286 | A2 | 10/2002 |
| WO | WO02/090713 | | 11/2002 |
| WO | WO02/103150 | A2 | 12/2002 |
| WO | WO03/004819 | A2 | 1/2003 |
| WO | WO03/004819 | A3 | 1/2003 |
| WO | WO03/004820 | A2 | 1/2003 |
| WO | WO03/004820 | A3 | 1/2003 |
| WO | WO03/008756 | A1 | 1/2003 |
| WO | WO03/012255 | A1 | 2/2003 |
| WO | WO03/016669 | A2 | 2/2003 |
| WO | WO03/016669 | A3 | 2/2003 |
| WO | WO03/023178 | A2 | 3/2003 |
| WO | WO03/023178 | A3 | 3/2003 |
| WO | WO03/023179 | A2 | 3/2003 |
| WO | WO03/023179 | A3 | 3/2003 |
| WO | WO03/029607 | A1 | 4/2003 |
| WO | WO03/029608 | A1 | 4/2003 |
| WO | WO03/042486 | A2 | 5/2003 |
| WO | WO03/042486 | A3 | 5/2003 |
| WO | WO03/042487 | A2 | 5/2003 |
| WO | WO03/042487 | A3 | 5/2003 |
| WO | WO03/042489 | A2 | 5/2003 |
| WO | WO03/048520 | A1 | 6/2003 |
| WO | WO03/048521 | A2 | 6/2003 |
| WO | WO03/055616 | A2 | 7/2003 |
| WO | WO03/058022 | A2 | 7/2003 |
| WO | WO03/058022 | A3 | 7/2003 |
| WO | WO03/059549 | A1 | 7/2003 |
| WO | WO03/064813 | A1 | 8/2003 |
| WO | WO03/071086 | A2 | 8/2003 |
| WO | WO03/071086 | A3 | 8/2003 |
| WO | WO03/078785 | A2 | 9/2003 |
| WO | WO03/078785 | A3 | 9/2003 |
| WO | WO03/086675 | A2 | 10/2003 |
| WO | WO03/089161 | A2 | 10/2003 |
| WO | WO03/089161 | A3 | 10/2003 |
| WO | WO03/093623 | A2 | 11/2003 |
| WO | WO03/093623 | A3 | 11/2003 |
| WO | WO03/102365 | A1 | 12/2003 |
| WO | WO03/104601 | A2 | 12/2003 |
| WO | WO03/104601 | A3 | 12/2003 |
| WO | WO03/106130 | A2 | 12/2003 |
| WO | WO04/003337 | A1 | 1/2004 |
| WO | WO04/009950 | A1 | 1/2004 |
| WO | WO04/010039 | A2 | 1/2004 |
| WO | WO04/010039 | A3 | 1/2004 |
| WO | WO04/011776 | A2 | 2/2004 |
| WO | WO04/011776 | A3 | 2/2004 |
| WO | WO04/018823 | A2 | 3/2004 |
| WO | WO04/018823 | A3 | 3/2004 |
| WO | WO04/018824 | A2 | 3/2004 |
| WO | WO04/023014 | A3 | 3/2004 |
| WO | WO04/026017 | A3 | 4/2004 |
| WO | WO04/026073 | A2 | 4/2004 |
| WO | WO04/026073 | A3 | 4/2004 |
| WO | WO04/026500 | A2 | 4/2004 |
| WO | WO04/026500 | A3 | 4/2004 |
| WO | WO04/027200 | A2 | 4/2004 |
| WO | WO04/027200 | A3 | 4/2004 |
| WO | WO04/027204 | A2 | 4/2004 |
| WO | WO04/027204 | A3 | 4/2004 |
| WO | WO04/027205 | A2 | 4/2004 |
| WO | WO04/027205 | A3 | 4/2004 |
| WO | WO04/027392 | A1 | 4/2004 |
| WO | WO04/027786 | A2 | 4/2004 |
| WO | WO04/027786 | A3 | 4/2004 |
| WO | WO04/053434 | A2 | 6/2004 |
| WO | WO04/053434 | A3 | 6/2004 |
| WO | WO04/057715 | A2 | 7/2004 |
| WO | WO04/057715 | A3 | 7/2004 |
| WO | WO04/067961 | A2 | 8/2004 |
| WO | WO04/072436 | A1 | 8/2004 |
| WO | WO04/074622 | A2 | 9/2004 |
| WO | WO04/074622 | A3 | 9/2004 |
| WO | WO04/076798 | A2 | 9/2004 |
| WO | WO04/076798 | A3 | 9/2004 |
| WO | WO04/081346 | A2 | 9/2004 |
| WO | WO04/083591 | A2 | 9/2004 |
| WO | WO04/083591 | A3 | 9/2004 |
| WO | WO04/083592 | A2 | 9/2004 |
| WO | WO04/083592 | A3 | 9/2004 |
| WO | WO04/083593 | A2 | 9/2004 |
| WO | WO04/083594 | A2 | 9/2004 |
| WO | WO04/083594 | A3 | 9/2004 |
| WO | WO04/085790 | A2 | 10/2004 |
| WO | WO04/089608 | A2 | 10/2004 |
| WO | WO04/092527 | A2 | 10/2004 |
| WO | WO04/092528 | A2 | 10/2004 |
| WO | WO04/092530 | A2 | 10/2004 |
| WO | WO04/092530 | A3 | 10/2004 |
| WO | WO04/094766 | A2 | 11/2004 |
| WO | WO05/017303 | A2 | 2/2005 |
| WO | WO05/021921 | A2 | 3/2005 |
| WO | WO05/021921 | A3 | 3/2005 |
| WO | WO05/021922 | A2 | 3/2005 |
| WO | WO05/021922 | A3 | 3/2005 |
| WO | WO05/024170 | A2 | 3/2005 |
| WO | WO05/024171 | A2 | 3/2005 |
| WO | WO05/028803 | A2 | 3/2005 |
| WO | WO05/071212 | A1 | 4/2005 |
| WO | WO05/081803 | A2 | 9/2005 |
| WO | WO05/086614 | A2 | 9/2005 |

OTHER PUBLICATIONS

Offshore, "Agbada Well Solid Tubulars Expanded Bottom Up, Screens Expanded Top Down" William Furlow, Jan. 2002.(copy not available).

Drilling Contractor, "Solid Expandable Tubulars are Enabling Technology" Mar./Apr. 2001 . (copy not available).

Hart's E & P, "SET Technology: Setting the Standard" Mar. 2002.
Hart's E & P, "An Expanded Horizon" Jim Brock, Lev Ring, Scott Costa, Andrei Filippov. Feb. 2000.
Hart's E & P, "Technology Strategy Breeds Value" Ali Daneshy. May 2004.
Hart's E & P, "Solid Expandable Tubulars Slimwell: Stepping Stone to MonoDiameter" Jun. 2003.
Innovators Chart the Course, Shell Exploration & Production.
"Case Study: Value in Drilling Derived From Application-Specific Technology" Langley, Diane., Oct. 2004.
L'Usine Nouvelle, "Les Tubes Expansibles Changent La Face Du Forage Petrolier" Demoulin, Laurence, No. 2878 . pp. 50-52, Jul. 3, 2003.
Offshore, "Monodiameter Technology Keeps Hole Diameter to TD", Hull, Jennifer., Oct. 2002.
News Release, "Shell and Halliburton Agree to Form Company to Develop and Market Expandable Casing Technology", 1998.
Offshore, "Expandable Tubulars Enable Multilaterals Without Compromise on Hole Size," DeMong, Karl, et al., Jun. 2003.
Offshore Engineer, "From Exotic to Routine—the offshore quickstep" Apr. 2004, pp. 77-83.
Offshore, "Expandable Solid Casing Reduces Telescope Effect," Furlow, William, Aug. 1998, pp. 102 & 140.
Offshore, "Casing Expansion, Test Process Fine Tuned on Ultradeepwater Well," Furlow, William, Dec. 2000.
Offshore Engineer, "Oilfield Service Trio Target Jules Verne Territory," Von Flater, Rick., Aug. 2001.
Offshore, "Expandable Casing Program Helps Oprator Hit TD With Larger Tubulars" Furlow, William, Jan. 2000.
Offshore, "Same Internal Casing Diameter From Surface to TD", Cook, Lance., Jul. 2002.
Oil and Gas Investor, "Straightening the Drilling Curve," Williams, Peggy. Jan. 2003.
Petroleum Engineer International, "Expandable Casing Accesses Remote Reservoirs" Apr. 1999.
New Technology Magazine, "Pipe Dream Reality," Smith, Maurice, Dec. 2003.
Roustabout, "First ever SET Workshop Held in Aberdeen," Oct. 2004.
Roustabout, "Enventure Ready to Rejuvenate the North Sea" Sep. 2004.
EP Journal of Technology, "Solid Expandable Tubulars (SET) Provide Value to Operators Worldwide in a Variety of Applications," Fonlova, Rick, Apr. 2005.
The American Oil & Gas Reporter, "Advances Grow Expandable Applications," Bullock, Michael D., Sep. 2004.
Upstream, "Expandable Tubulars Close in on the Holy Grail of Drilling", Cottrill, Adrian, Jul. 26, 2002.
Oil and Gas, "Shell Drills World's First Monodiameter Well in South Texas" Sumrow, Mike., Oct. 21, 2002.
World Oil, "Expandables and the Dream of the Monodiameter Well: A Status Report", Fischer, Perry, Jul. 2004.
World Oil, "Well Remediation Using Expandable Cased-Hole Liners", Merritt, Randy et al., Jul. 2002.
World Oil, "How in Situ Expansion Affects Casing and Tubing Propeties", Mack, R.D., et al., Jul. 1999. pp. 69-71.
Enventure Global Technology "Expandable Tubular Technology—Drill Deeper, Farther, More Economically" Mark Rivenbark.
Society of Petroleum Engineers, "Addressing Common Drilling Challenges Using Solid Expandable Tubular Technology" Perez-Roca, Eduardo, et al., 2003.
Society of Petroleum Engineers, "Monodiameter Drilling Liner—From Concept to Reality" Dean, Bill, et al. 2003.
Offshore Technology Conference, "Expandable Liner Hangers: Case Histories" Moore, Melvin, J., et al., 2002.
Offshore Technology Conference, "Deepwater Expandable Openhole Liner Case Histories: Learnings Through Field Applications" Grant, Thomas P., et al., 2002.
Offshore Technology Conference, "Realization of the MonoDiameter Well: Evolution of a Game-Changing Technology" Dupal, Kenneth, et al., 2002.
Offshore Technology Conference, "Water Production Reduced Using Solid Expandable Tubular Technology to "Clad" in Fractured Carbonate Formation" van Noort, Roger, et al., 2003.
Offshore Technology Conference, "Overcoming Well Control Challenges with Solid Expandable Tubular Technoogy" Patin, Michael, et al., 2003.
Offshore Technology Conference, "Expandable Cased-hole Liner Remediates Prolific Gas Well and Minimizes Loss of Production" Buckler Bill, et al., 2002.
Offshore Technology Conference, "Development and Field Testing of Solid Expandable Corrosion Resistant Cased-hole Liners to Boost Gas Production in Corrosive Environments" Siemers Gertjan, et al., 2003.
"Practices for Providing Zonal Isolation in Conjunction with Expandable Casing Jobs-Case Histories" Sanders, T, et al. 2003.
Society of Petroleum Engineers, "Increasing Solid Expandable Tubular Technology Reliability in a Myriad of Downhole Environments", Escobar, C. et al., 2003.
Society of Petroleum Engineers, "Water Production Management—PDO's Successful Application of Expandable Technology", Braas, JCM., et al., 2002.
Society of Petroleum Engineers, "Expandable Tubular Solutions", Filippov, Andrei, et al., 1999.
Society of Petroleum Engineers, "Expandable Liner Hanger Provides Cost-Effective Alternative Solution" Lohoefer, C. Lee, et al., 2000.
Society of Petroleum Engineers, "Solid Expandable Tubular Technology—A Year of Case Histories in the Drilling Environment" Dupal, Kenneth, et al., 2001.
"In-Situ Expansion of Casing and Tubing" Mack, Robert et al.
Society of Petroleum Engineers, "Expandable Tubulars: Field Examples of Application in Well Construction and Remediation" Diagle, Chan, et al., 2000.
AADE Houston Chapter, "Subsidence Remediation—Extending Well Life Through the Use of Solid Expandable Casing Systems" Shepherd, David, et al., Mar. 2001 Conference.
Society of Petroleum Engineers, "Planning the Well Construction Process for the Use of Solid Expandable Casing" DeMong, Karl, et al., 2003.
Enventure Global Technology, "The Development and Applications of Solid Expandable Tubular Technology" Cales, GL., 2003.
Society of Petroleum Engineers, "Installation of Solid Expandable Tubular Systems Through Milled Casing Windows" Waddell, Kevin, et al., 2004.
Society of Petroleum Engineers, "Solid Expandable Tubular Technology in Mature Basins" Blasingame, Kate, et al., 2003.
"Casing Design in Complex Wells: The Use of Expandables and Multilateral Technology to Attack the size Reduction Issue" DeMong, Karl., et al.
"Well Remediation Using Expandable Cased-Hole Liners—Summary of Case Histories" Merritt, Randy, et al.
Offshore Technology Conference, "Transforming Conventional Wells to Bigbore Completions Using Solid Expandable Tubular Technology" Mohd Nor, Norlizah, et al., 2002.
Society of Petroleum Engineers, "Using Solid Expandable Tubulars for Openhole Water Shutoff" van Noort, Roger, et al., 2002.
Society of Petroleum Engineers, "Case Histories—Drilling and Recompletion Applications Using Solid Expandable Tubular Technology" Campo. Don, et al., 2002.
Society of Petroleum Engineers, "Reaching Deep Reservoir Targets Using Solid Expandable Tubulars" Gusevik Rune, et al., 2002.
Society of Petroleum Engineers, "Breakthroughs Using Solid Expandable Tubulars to Construct Extended Reach Wells" Demong, Karl, et al., 2004.
Deep Offshore Technology Conference "Meeting Economic Challenges of Deepwater Drilling with Expandable-Tubular Technology" Haut, Richard, et al.,1999.
Offshore Technology Conference, "Field Trial Proves Upgrades to Solid Expandable Tubulars" Moore, Melvin, et al., 2002.
"Well Design with Expandable Tubulars Reduces Cost and Increases Success in Deepwater Applications" Dupal, Ken, et al., Deep Shore Technology 2000.

Offshore Technology Conference, "Reducing Non-Productive Time Through the Use of Solid Expandable Tubulars: How to Beat the Curve Through Pre-Planning" Cales, Gerry, et al., 2004.
Offshore Technology Conference, "Three Diverse Applications on Three Continents for a Single Major Operator" Sanders, Tom, et al., 2004.
Offshore Technology Conference,, "Expanding Oil Field Tubulars Through a Window Demonstrates Value and Provides New Well Construction Option" Sparling, Steven, et al., 2004.
Society of Petroleum Engineers, "Advances in Single-diameter Well Technology: The Next Step to Cost-Effective Optimization" Waddell, Kevin, et al., 2004.
Society of Petroleum Engineers, "New Technologies Combine to Reduce Drilling Cost in Ultradeepwater Applications" Touboul, Nicolas, et al., 2004.
Society of Petroleum Engineers, "Solid Expandable Tubular Technology: *The Value of Planned Installation vs. Contingency*" Rivenbark, Mark, et al., 2004.
Society of Petroleum Engineers, "Changing Safety Paradigms in the Oil and Gas Industry" Ratilff, Matt, et al., 2004.
"Casing Remediation—Extending Well Life Through The Use of Solid Expandable Casing Systems" Merritt, Randy, et al.
Society of Petroleum Engineers, "Window Exit Sidetrack Enhancements Through the Use of Solid Expandable Casing", Rivenbark, Mark, et al., 2004.
"Solid Expandable Tubular Technology: *The Value of Planned Installations vs. Contingency*", Carstens, Chris, et al.
Data Sheet, "Enventure Cased-Hole Liner (CHL) System" Enventure Global Technology, Dec. 2002.
Case History, "Graham Ranch No. 1 Newark East Barnett Field" Enventure Global Technology, Feb. 2002.
Case History, "K.K. Camel No. 1 Ridge Field Lafayette Parish, Louisiana" Enventure Global Technology, Feb. 2002.
Case History, "Eemskanaal—2 Groningen" Enventure Global Technology, Feb. 2002.
Case History, "Yibal 381 Oman" Enventure Global Technology, Feb. 2002.
Case History, "Mississippi Canyon 809 URSA TLP, OSC-G 5868, No. A-12" Enventure Global Technology, Mar. 2004.
Case History, "Unocal Sequoia Mississippi Canyon 941 Well No. 2" Enventure Global Technology, 2005.
"SET Technology: The Facts" Enventure Global Technology, 2004.
Data Sheet, "Enventure Openhole Liner (OHL) System" Enventure Global Technology, Dec. 2002.
Data Sheet, "Window Exit Applications OHL Window Exits Expansion" Enventure Global Technology, Jun. 2003.
"Expand Your Opportunities." *Enventure*. CD-ROM. Jun. 1999.
"Expand Your Opportunities." *Enventure*. CD-ROM. May 2001.
International Examination Report, Application PCT/US02/39418, Feb. 18, 2005.
International Examination Report, Application PCT/US03/06544, May 10, 2005.
International Examination Report, Application PCT/US03/11765;; Jan. 25, 2005.
International Examination Report, Application PCT/US03/13787; Mar. 2, 2005.
International Examination Report, Application PCT/US03/14153; May 12, 2005.
International Examination Report, Application PCT/US03/15020, May 9, 2005.
International Examination Report, Application PCT/US03/25667, May 25, 2005.
International Search Report, Application PCT/US03/25716; Jan. 13, 2005.
International Examination Report, Application PCT/US03/29858; May 23, 2005.
International Search Report, Application PCT/US03/38550; May 23, 2005.
International Preliminary Report on Patentability, Application PCT/US04/02122; May 13, 2005.
International Preliminary Report on Patentability, Application PCT/US04/04740; Apr. 27, 2005.
International Preliminary Report on Patentability, Application PCT/US04/06246; May 5, 2005.
International Preliminary Report on Patentability, Application PCT/US04/08030; Apr. 7, 2005.
International Preliminary Report on Patentability, Application PCT/US04/08030; Jun. 10, 2005.
International Preliminary Report on Patentability, Application PCT/US04/08073; May 9, 2005.
International Preliminary Report on Patentability, Application PCT/US04/11177;Jun. 9, 2005.
Examination Report to Application No. AU 2001278196 ,Apr. 21, 2005.
Examination Report to Application No. AU 2002237757 ,Apr. 28, 2005.
Examination Report to Application No. AU 2002240366 ,Apr. 13, 2005.
Search Report to Application No. EP 02806451.7; Feb. 9, 2005.
Examination Report to Application No. GB 0225505.7 Feb. 15, 2005.
Examination Report to Application No. GB 0400019.6; May 19, 2005.
Examination Report to Application No. GB 0403891.5, Feb. 14, 2005.
Examination Report to Application No. GB 0403893.1, Feb. 14, 2005.
Examination Report to Application No. GB 0403894.9, Feb. 15, 2005.
Examination Report to Application No. GB 0403920.2, Feb. 15, 2005.
Examination Report to Application No. GB 0403921.0, Feb. 15, 2005.
Examination Report to Application No. GB 0404796.5; Apr. 14, 2005.
Examination Report to Application No. GB 0406257.6, Jan. 25, 2005.
Examination Report to Application No. GB 0406258.4; Jan. 12, 2005.
Examination Report to Application No. GB 0408672.4, Mar. 21, 2005.
Examination Report to Application No. GB 0411698.4, Jan. 24, 2005.
Examination Report to Application No. GB 0411892.3, Feb. 21, 2005.
Examination Report to Application No. GB 0412533.2, May 20, 2005.
Search Report to Application No. GB 0415835.8; Mar. 10, 2005.
Examination Report to Application No. 0416625.2 Jan. 20, 2005.
Search and Examination Report to Application No. GB 0425948.7 Apr. 13, 2005.
Search and Examination Report to Application No. GB 0425951.1 Apr. 14, 2005.
Search and Examination Report to Application No. GB 0425956.0 Apr. 14, 2005.
Search and Examination Report to Application No. GB 0426155.8 Jan. 12, 2005.
Search and Examination Report to Application No. GB 0426156.6 Jan. 12, 2005.
Search and Examination Report to Application No. GB 0426157.4 Jan. 12, 2005.
Examination Report to Application No. GB 0428141.6 Feb. 9, 2005.
Examination Report to Application No. GB 0500184.7 Feb. 9, 2005.
Search and Examination Report to Application No. GB 0500600.2 Feb. 15, 2005.
Examination Report to Application No. GB 0501667.0 May 27, 2005.
Search and Examination Report to Application No. GB 0503470.7 Mar. 21, 2005.
Search and Examination Report to Application No. GB 0506697.2 May 20, 2005.
Written Opinion to Application No. PCT/US02/25608 Feb. 2, 2005.
Written Opinion to Application No. PCT/US03/25675 Nov. 24, 2004.

Written Opinion to Application No. PCT/US02/25727; May 17, 2004.
Written Opinion to Application No. PCT/US02/39418; Jun. 9, 2004.
Written Opinion to Application No. PCT/US02/39425; Nov. 22, 2004.
Written Opinion to Application No. PCT/US02/39425; Apr. 11, 2005.
Written Opinion to Application No. PCT/US03/06544; Feb. 18, 2005.
Written Opinion to Application No. PCT/US03/11765 May 11, 2004.
Written Opinion to Application No. PCT/US03/13787 Nov. 9, 2004.
Written Opinion to Application No. PCT/US03/14153 Sep. 9, 2004.
Written Opinion to Application No. PCT/US03/14153 Nov. 9, 2004.
Written Opinion to Application No. PCT/US03/18530 Sep. 13, 2004.
Written Opinion to Application No. PCT/US03/19993 Oct. 15, 2004.
Written Opinion to Application No. PCT/US03/25675 May 9, 2005.
Written Opinion to Application No. PCT/US03/29858 Jan. 21, 2004.
Written Opinion to Application No. PCT/US03/38550 Dec.10, 2004.
Written Opinion to Application No. PCT/US04/08171 May 5, 2005.
Combined Search Report and Written Opinion to Application No. PCT/US04/00631; Mar. 28, 2005.
Combined Search Report and Written Opinion to Application No. PCT/US04/02122 Feb. 24, 2005.
Combined Search Report and Written Opinion to Application No. PCT/US04/04740 Jan. 19, 2005.
Combined Search Report and Written Opinion to Application No. PCT/US04/06246 Jan. 26, 2005.
Combined Search Report and Written Opinion to Application No. PCT/US04/08030 Jan. 6, 2005.
Combined Search Report and Written Opinion to Application No. PCT/US04/08073 Mar. 4, 2005.
Combined Search Report and Written Opinion to Application No. PCT/US04/08170 Jan. 13, 2005.
Combined Search Report and Written Opinion to Application No. PCT/US04/08171 Feb. 16, 2005.
Combined Search Report and Written Opinion to Application No. PCT/US04/11172 Feb. 14, 2005.
Combined Search Report and Written Opinion to Application No. PCT/US04/28438 Mar. 14, 2005.
International Examination Report, Application PCT/US02/24399, Aug. 6, 2004.
Examination Report, Application PCT/US02/25727; Jul. 7, 2004.
Examination Report, Application PCT/US03/10144; Jul. 7, 2004.
International Examination Report, Application PCT/US03/11765; Dec. 10, 2004.
International Search Report, Application PCT/US03/20870; Sep. 30, 2004.
International Examination Report, Application PCT/US03/25676, Aug. 17, 2004.
International Examination Report, Application PCT/US03/25677, Aug. 17, 2004.
International Search Report, Application PCT/US03/25742; Dec. 20, 2004.
International Examination Report, Application PCT/US03/29460; Dec. 8, 2004.
International Examination Report, Application PCT/US03/29859, Aug. 16, 2004.
Examination Report to Application GB 0220872.6, Oct. 29, 2004.
Examination Report to Application No. GB 0225505.7, Oct. 27, 2004.
Examination Report to Application No. GB 0306046.4, Sep. 10, 2004.
Examination Report to Application No. GB 0400018.8; Oct. 29, 2004.
Examination Report to Application No. GB 0400019.6; Oct. 29, 2004.
Search and Examination Report to Application No. GB 0404833.6, Aug. 19, 2004.
Examination Report to Application No. GB 0404837.7, Jul. 12, 2004.
Examination Report to Application No. GB 0408672.4, Jul. 12, 2004.
Examination Report to Application No. GB 0404830.2, Aug. 17, 2004.
Search and Examination Report to Application No. GB 0411892.3, Jul. 14, 2004.
Search and Examination Report to Application No. GB 0411893.3, Jul. 14, 2004.
Search and Examination Report to Application No. GB 0412190.1, Jul. 22, 2004.
Search and Examination Report to Application No. GB 0412191.9, Jul. 22, 2004.
Search and Examination Report to Application No. GB 0412192.7, Jul. 22, 2004.
Search Report to Application No. GB 0415835.8, Dec. 2, 2004.
Search and Examination Report to Application No. GB 0416834.0, Aug. 11, 2004.
Search and Examination Report to Application No. GB 0416834.0, Nov. 16, 2004.
Search and Examination Report to Application No. GB 0417810.9, Aug. 25, 2004.
Search and Examination Report to Application No. GB 0417811.7, Aug. 25, 2004.
Search and Examination Report to Application No. GB 0418005.5, Aug. 25, 2004.
Search and Examination Report to Application No. GB 0418425.5, Sep. 10, 2004.
Search and Examination Report to Application No. GB 0418426.3 Sep. 10, 2004.
Search and Examination Report to Application No. GB 0418427.1 Sep. 10, 2004.
Search and Examination Report to Application No. GB 0418429.7 Sep. 10, 2004.
Search and Examination Report to Application No. GB 0418430.5 Sep. 10, 2004.
Search and Examination Report to Application No. GB 0418431.3 Sep. 10, 2004.
Search and Examination Report to Application No. GB 0418432.1 Sep. 10, 2004.
Search and Examination Report to Application No. GB 0418433.9 Sep. 10, 2004.
Search and Examination Report to Application No. GB 0418439.6 Sep. 10, 2004.
Search and Examination Report to Application No. GB 0418442.0 Sep. 10, 2004.
Examination Report to Application No. GB 0422419.2 Dec. 8, 2004.
Search and Examination Report to Application No. GB 0422893.8 Nov. 24, 2004.
Search and Examination Report to Application No. GB 0423416.7 Nov. 12, 2004.
Search and Examination Report to Application No. GB 0423417.5 Nov. 12, 2004.
Search and Examination Report to Application No. GB 0423418.3 Nov. 12, 2004.
Written Opinion to Application No. PCT/US01/19014; Dec. 10, 2002.
Written Opinion to Application No. PCT/US02/25608 Sep. 13, 2004.
Written Opinion to Application No. PCT/US02/25675 Nov. 24, 2004.
Michigan Metrology "3D Surface Finish Roughness Texture Wear WYKO Veeco" C.A. Brown, PHD; Charles, W.A. Johnsen, S. Chester.
International Search Report, Application PCT/US02/00677, Feb. 24, 2004.
International Search Report, Application PCT/US02/20477; Apr. 6, 2004.
International Search Report, Application PCT/US02/24399; Feb. 27, 2004.

International Search Report, Application PCT/US02/25608; May 24, 2004.
International Search Report, Application PCT/US02/25727; Feb. 19, 2004.
International Search Report, Application PCT/US02/36157; Sep. 29, 2003.
International Search Report, Application PCT/US02/36157; Apr. 14, 2004.
International Search Report, Application PCT/US02/36267; May 21, 2004.
International Search Report, Application PCT/US02/39425, May 28, 2004.
International Search Report, Application PCT/US03/00609, May 20, 2004.
International Search Report, Application PCT/US03/04837, May 28, 2004.
International Search Report, Application PCT/US03/06544, Jun. 9, 2004.
International Search Report, Application PCT/US03/13787; May 28, 2004.
International Search Report, Application PCT/US03/14153; May 28, 2004.
International Search Report, Application PCT/US03/18530; Jun. 24, 2004.
International Search Report, Application PCT/US03/19993; May 24, 2004.
International Search Report, Application PCT/US03/20870; May 24, 2004.
International Search Report, Application PCT/US03/24779; Mar. 3, 2004.
International Search Report, Application PCT/US03/25675; May 25, 2004.
International Search Report, Application PCT/US03/25676; May 17, 2004.
International Search Report, Application PCT/US03/25677; May 21, 2004.
International Search Report, Application PCT/US03/25707; Jun. 23, 2004.
International Search Report, Application PCT/US03/25715; Apr. 9, 2004.
International Search Report, Application PCT/US03/25742; May 27, 2004.
International Search Report, Application PCT/US03/29460; May 25, 2004.
International Search Report, Application PCT/US03/25667; Feb. 26, 2004.
International Search Report, Application PCT/US03/29859; May 21, 2004.
International Search Report, Application PCT/US03/38550; Jun. 15, 2004.
Examination Report to Application No. GB 0208367.3, Jan. 30, 2004.
Examination Report to Application No. GB 0216409.3, Feb. 9, 2004.
Examination Report to Application No. GB 0219757.2, May 10, 2004.
Examination Report to Application No. GB 0314846.7, Jul. 15, 2004.
Search and Examination Report to Application No. GB 0308293.0, Jul. 14, 2003.
Search and Examination Report to Application No. GB 0308294.8, Jul. 14, 2003.
Search and Examination Report to Application No. GB 0308295.5, Jul. 14, 2003.
Search and Examination Report to Application No. GB 0308296.3, Jul. 14, 2003.
Search and Examination Report to Application No. GB 0308297.1, Jul. 2003.
Search and Examination Report to Application No. GB 0308303.7, Jul. 14, 2003.
Examination Report to Application No. GB 0311596.1, May 18, 2004.
Examination Report to Application No. GB 0320747.9, May 25, 2004.
Examination Report to Application No. GB 0325071.9, Feb. 2, 2004.
Examination Report to Application No. GB 0325072.7, Feb. 5, 2004.
Examination Report to Application No. GB 0325072.7; Apr. 13, 2004.
Search and Examination Report to Application No. GB 0404832.8, Apr. 21, 2004.
Search and Examination Report to Application No. GB 0404833.6, Apr. 21, 2004.
Search and Examination Report to Application No. GB 0404837.7, May 17, 2004.
Search and Examination Report to Application No. GB 0404839.3, May 14, 2004.
Search and Examination Report to Application No. GB 0404842.7, May 14, 2004.
Search and Examination Report to Application No. GB 0404845.0, May 14, 2004.
Search and Examination Report to Application No. GB 0404849.2, May 17, 2004.
Examination Report to Application No. GB 0406257.6, Jun. 28, 2004.
Examination Report to Application No. GB 0406258.4, May 20, 2004.
Search and Examination Report to Application No. GB 0411894.9, Jun. 30, 2004.
Written Opinion to Application No. PCT/US01/28960; Dec. 2, 2002.
Written Opinion to Application No. PCT/US01/30256; Nov. 11, 2002.
Written Opinion to Application No. PCT/US02/00093; Apr. 21, 2003.
Written Opinion to Application No. PCT/US02/00677; Apr. 17, 2003.
Written Opinion to Application No. PCT/US02/04353; Apr. 11, 2003.
Written Opinion to Application No. PCT/US02/20256; May 9, 2003.
Written Opinion to Application No. PCT/US02/24399; Apr. 28, 2004.
Halliburton Energy Services, "Halliburton Completion Products" 1996, Page Packers 5-37, United States of America.
Turcotte and Schubert, Geodynamics (1982) John Wiley & Sons, Inc., pp. 9, 432.
Baker Hughes Incorporated, "EXPatch Expandable Cladding System" (2002).
Baker Hughes Incorporated, "EXPress Expandable Screen System".
High-Tech Wells, "World's First Completion Set Inside Expandable Screen" (2003) Gilmer, J.M., Emerson, A.B.
Baker Hughes Incorporated, "Technical Overview Production Enhancement Technology" (Mar. 10, 2003) Geir Owe Egge.
Baker Hughes Incorporated, "FORMlock Expandable Liner Hangers".
Weatherford Completion Systems, "Expandable Sand Screens" (2002).
Expandable Tubular Technology, "EIS Expandable Isolation Sleeve" (Feb. 2003).
Oilfield Catalog; "Jet-Lok Product Application Description" (Aug. 8, 2003).
Power Ultrasonics, "Design and Optimisation of an Ultrasonic Die System For Form" Chris Cheers (1999, 2000).
Research Area—Sheet Metal Forming—Superposition of Vibra; Fraunhofer IWU (2001).
Research Projects;"Analysis of Metal Sheet Formability and It's Factors of Influence" Prof. Dorel Banabic (2003).
www.materialsresources.com, "Low Temperature Bonding of Dissimilar and Hard-to-Bond Materials and Metal-Including . . . " (2004).
www.tribtech.com. "Trib-gel A Chemical Cold Welding Agent" G R Linzell (Sep. 14, 1999).

www.spurind.com, "Galvanic Protection, Metallurgical Bonds, Custom Fabrication—Spur Industries" (2000).
Lubrication Engineering, "Effect of Micro-Surface Texturing on Breakaway Torque and Blister Formation on Carbon-Graphite Faces in a Mechanical Seal" Philip Guichelaar, Karalyn Folkert, Izhak Etsion, Steven Pride (Aug. 2002).
Surface Technologies Inc., "Improving Tribological Performance of Mechanical Seals by Laser Surface Texturing" Izhak Etsion.
Tribology Transactions "Experimental Investigation of Laser Surface Texturing for Reciprocating Automotive Components" G Ryk, Y Klingerman and I Etsion (2002).
Proceeding of the International Tribology Conference, "Microtexturing of Functional Surfaces for Improving Their Tribological Performance" Henry Haefke, Yvonne Gerbig, Gabriel Dumitru and Valerio Romano (2002).
Sealing Technology, "A laser surface textured hydrostatic mechanical seal" Izhak Etsion and Gregory Halperin (Mar. 2003).
Metalforming Online, "Advanced Laser Texturing Tames Tough Tasks" Harvey Arbuckle.
Tribology Transactions, "A Laser Surface Textured Parallel Thrust Bearing" V. Brizmer, Y. Klingerman and I. Etsion (Mar. 2003).
PT Design, "Scratching the Surface" Todd E. Lizotte (Jun. 1999).
Tribology Transactions, "Friction-Reducing Surface-Texturing in Reciprocating Automotive Components" Aviram Ronen, and Izhak Etsion (2001).
International Search Report, Application PCT/US01/04753, Jul. 3, 2001.
International Search Report, Application PCT/IL00/00245, Sep. 18, 2000.
International Search Report, Application PCT/US00/18635, Nov. 24, 2000.
International Search Report, Application PCT/US00/30022, Mar. 27, 2001.
International Search Report, Application PCT/US00/27645, Dec. 29, 2000.
International Search Report, Application PCT/US01/19014, Nov. 23, 2001.
International Search Report, Application PCT/US01/41446, Oct. 30, 2001.
International Search Report, Application PCT/US01/23815, Nov. 16, 2001.
International Search Report, Application PCT/US01/28960, Jan. 22, 2002.
International Search Report, Application PCT/US01/30256, Jan. 3, 2002.
International Search Report, Application PCT/US02/04353, Jun. 24, 2002.
International Search Report, Application PCT/US02/00677, Jul. 17, 2002.
International Search Report, Application PCT/US02/00093, Aug. 6, 2002.
International Search Report, Application PCT/US02/29856, Dec. 16, 2002.
International Search Report, Application PCT/US02/20256, Jan. 3, 2003.
International Search Report, Application PCT/US02/39418, Mar. 24, 2003.
International Search Report, Application PCT/US03/15020; Jul. 30, 2003.
International Search Report, Application PCT/US02/20477; Oct. 31, 2003.
International Search Report, Application PCT/US03/10144; Oct. 31, 2003.
International Search Report, Application PCT/US03/20694; Nov. 12, 2003.
International Search Report, Application PCT/US03/11765; Nov. 13, 2003.
Search Report to Application No. GB 9926450.9, Feb. 28, 2000.
Search Report to Application No. GB 9926449.1, Mar. 27, 2000.
Search Report to Application No. GB 9930398.4, Jun. 27, 2000.
Search Report to Application No. GB 0004285.3, Jul. 12, 2000.
Search Report to Application No. GB 0003251.6, Jul. 13, 2000.
Examination Report to Application No. GB 0005399.1; Jul. 24, 2000.
Search Report to Application No. GB 0004282.0, Jul. 31, 2000.
Search Report to Application No. GB 0013661.4, Oct. 20, 2000.
Search Report to Application No. GB 0004282.0 Jan. 15, 2001.
Search Report to Application No. GB 0004285.3, Jan. 17, 2001.
Search Report to Application No. GB 0005399.1, Feb. 15, 2001.
Search Report to Application No. GB 0013661.4, Apr. 17, 2001.
Examination Report to Application No. GB 9926450.9, May 15, 2002.
Search Report to Application No. GB 9926449.1, Jul. 4, 2001.
Search Report to Application No. GB 9926449.1, Sep. 5, 2001.
Search Report to Application No. 1999 5593, Aug. 20, 2002.
Search Report to Application No. GB 0004285.3, Aug. 28, 2002.
Examination Report to Application No. GB 0005399.1; Oct. 14, 2002.
Examination Report to Application No. GB 9926450.9, Nov. 22, 2002.
Search Report to Application No. GB 0219757.2, Nov. 25, 2002.
Search Report to Application No. GB 0220872.6, Dec. 5, 2002.
Search Report to Application No. GB 0219757.2, Jan. 20, 2003.
Search Report to Application No. GB 0013661.4, Feb. 19, 2003.
Search Report to Application No. GB 0225505.7, Mar. 5, 2003.
Search Report to Application No. GB 0220872.6, Mar. 13, 2003.
Examination Report to Application No. GB 0004285.3, Mar. 28, 2003.
Examination Report to Application No. GB 0208367.3, Apr. 4, 2003.
Examination Report to Application No. GB 0212443.6, Apr. 10, 2003.
Search and Examination Report to Application No. GB 0308296.3, Jun. 2, 2003.
Search and Examination Report to Application No. GB 0308297.1, Jun. 2, 2003.
Search and Examination Report to Application No. GB 0308295.5, Jun. 2, 2003.
Search and Examination Report to Application No. GB 0308293.0, Jun. 2, 2003.
Search and Examination Report to Application No. GB 0308294.8, Jun. 2, 2003.
Search and Examination Report to Application No. GB 0308303.7, Jun. 2, 2003.
Search and Examination Report to Application No. GB 0308290.6, Jun. 2, 2003.
Search and Examination Report to Application No. GB 0308299.7, Jun. 2, 2003.
Search and Examination Report to Application No. GB 0308302.9, Jun. 2, 2003.
Search and Examination Report to Application No. GB 0004282.0, Jun. 3, 2003.
Search and Examination Report to Application No. GB 0310757.0, Jun. 12, 2003.
Search and Examination Report to Application No. GB 0310836.2, Jun. 12, 2003.
Search and Examination Report to Application No. GB 0310785.1, Jun. 12, 2003.
Search and Examination Report to Application No. GB 0310759.6, Jun. 12, 2003.
Search and Examination Report to Application No. GB 0310801.6, Jun. 12, 2003.
Search and Examination Report to Application No. GB 0310772.9, Jun. 12, 2003.
Search and Examination Report to Application No. GB 0310795.0, Jun. 12, 2003.
Search and Examination Report to Application No. GB 0310833.9, Jun. 12, 2003.
Search and Examination Report to Application No. GB 0310799.2, Jun. 12, 2003.
Search and Examination Report to Application No. GB 0310797.6, Jun. 12, 2003.
Search and Examination Report to Application No. GB 0310770.3, Jun. 12, 2003.

Search and Examination Report to Application No. GB 0310099.7, Jun. 24, 2003.
Search and Examination Report to Application No. GB 0310104.5, Jun. 24, 2003.
Search and Examination Report to Application No. GB 0310101.1, Jun. 24, 2003.
Search and Examination Report to Application No. GB 0310118.5, Jun. 24, 2003.
Search and Examination Report to Application No. GB 0310090.6, Jun. 24, 2003.
Search and Examination Report to Application No. GB 0225505.7, Jul. 1, 2003.
Examination Report to Application No. GB 0310836.2, Aug. 7, 2003.
Search and Examination Report to Application No. GB 0316883.8, Aug. 14, 2003.
Search and Examination Report to Application No. GB 0316886.1, Aug. 14, 2003.
Search and Examination Report to Application No. GB 0316887.9, Aug. 14, 2003.
Search and Examination Report to Application No. GB 0318547.4; Sep. 3, 2003.
Search and Examination Report to Application No. GB 0318549.3; Sep. 3, 2003.
Search and Examination Report to Application No. GB 0318545.1, Sep. 3, 2003.
Search and Examination Report to Application No. GB 0318550.1, Sep. 3, 2003.
Search and Examination Report to Application No. GB 0313406.1, Sep. 3, 2003.
Search and Examination Report to Application No. GB 0324174.2, Nov. 4, 2003.
Search and Examination Report to Application No. GB 0324172.6, Nov. 4, 2003.
Examination Report to Application No. GB 0208367.3, Nov. 17, 2003.
Search and Examination Report to Application No. GB 0325071.9, Nov. 18, 2003.
Examination Report to Application No. GB 0316886.1, Nov. 25, 2003.
Examination Report to Application No. GB 0316887.9 Nov. 25, 2003.
Examination Report to Application No. GB 0013661.4, Nov. 25, 2003.
Examination Report to Application No. GB 0316883.8, Nov. 25, 2003.
Examination Report to Application No. GB 0300085.8, Nov. 28, 2003.
Examination Report to Application No. GB 030086.6, Dec. 1, 2003.
Search and Examination Report to Application No. GB 0325072.7; Dec. 3, 2003.
Search and Examination Report to Application No. GB 0320579.6, Dec. 16, 2003.
Search and Examination Report to Application No. GB 0320580.4, Dec. 17, 2003.
Arbuckle, "Advanced Laser Texturing Tames Tough Tasks," Metal Forming Magazine.
Brizmer et al., "A Laser Surface Textured Parallel Thrust Bearing," *Tribology Transactions*, 46(3):397-403, 2003.
Duphorne, "Letter Re: Enventure Claims of Baker Infringement of Enventure's Expandable Patents," Apr. 1, 2005.
Egge, "Technical Overview Production Enhancement Technology," Baker Hughes, Mar. 10, 2003.
"EIS Expandable Isolation Sleeve" *Expandable Tubular Technology*, Feb. 2003.
Enventure Global Technology, Solid Expandable Tubulars are Enabling Technology, *Drilling Contractor*, Mar.-Apr. 2001.
Etsion, "Improving Tribological Performance of Mechanical Seals by Laser Surface Texturing," *Surface Technologies, LTD*.
Etsion, "A Laser Surface Textured Hydrostatic Mechanical Seal," *Sealing Technology*, Mar. 2003.
"Expandable Sand Screens," *Weatherford Completion Systems*, 2002.
Fontova, "Solid Expandable Tubulars (SET) Provide Value to Operators Worldwide in a Variety of Applications," *EP Journal of Technology*, Apr. 2005.
Fraunhofer Iwu, "Research Area: Sheet Metal Forming—Superposition of Vibrations," 2001.
Gilmer et al., "World's First Completion Set Inside Expandable Screen," *High-Tech Wells*, 2003.
Guichelaar et al., "Effect of Micro-Surface Texturing on Breakaway Torque and Blister Formation on Carbon-Graphite Faces in a Mechanical Seal," *Lubrication Engineering*, Aug. 2002.
Haefke et al., "Microtexturing of Functional Surfaces for Improving Their Tribological Performance," *Proceedings of the International Tribology Conference*, 2000.
Halliburton Completion Products, 1996.
Linzell, "Trib-Gel A Chemical Cold Welding Agent," 1999.
Lizotte, "Scratching The Surface," *PT Design*, Jun. 19993.
Power Ultrasonics, "Design and Optimisation of An Ultrasonic Die System For Forming Metal Cans," 1999.
Ratliff, "Changing Safety Paradigms in the Oil and Gas Industry," *Society of Petroleum Engineers*, SPE 90828, 2004.
Ronen et al., "Friction-Reducing Surface-Texturing in Reciprocating Automotive Components," *Tribology Transactions*, 44(3):359-366, 2001.
Rky et al., "Experimental Investigation of Laser Surface Texturing for Reciprocating Automotive Components," *Tribology Transactions*, 45(4):444-449, 2002.
Turcotte et al., "Geodynamics Applications of Continuum Physics to Geological Problems," 1982.
Von Flatern, "From Exotic to Routine—the Offshore Quick-step," *Offshore Engineer*, Apr. 2004.
Von Flatern, "Oilfield Service Trio Target Jules Verne Territory," *Offshore Engineer*, Aug. 2001.
www.JETLUBE.com, "Oilfield Catalog—Jet-Lok Product Applicatin Descriptions," 1998.
www.MATERIALSRESOURCES.com, "Low Temperature Bonding of Dissimilar and Hard-to-Bond Materials and Metals Including," 2004.
www.MITCHMET.com, "3d Surface Texture Parameters," 2004.
www.SPURIND.com, "Glavanic Protection, Metallurgical Bonds, Custom Fabrications—Spur Industries," 2000.
International Preliminary Examination Report, Application PCT/US03/11765, Jul. 18, 2005.
International Preliminary Examination Report, Application PCT/US01/11765, Aug. 15, 2005 (Corrected).
International Preliminary Examination Report, Application PCT/US03/20870, Sep. 30, 2004.
International Preliminary Examination Report, Application PCT/US03/25675, Aug. 30, 2005.
International Preliminary Examination Report, Application PCT/US03/25742, Dec. 20, 2004.
International Preliminary Examination Report, Application PCT/US03/38550, May 23, 2005.
International Preliminary Report on Patentability, Application PCT/US04/08171, Sep. 13, 2005.
International Preliminary Report on Patentability, Application PCT/US04/28438, Sep. 20, 2005.
Combined Search Report and Written Opinion to Application No. PCT/US04/11973, Sep. 27, 2005.
Combined Search Report and Written Opinion to Application No. PCT/US04/28423, Jul. 13, 2005.
Search Report to Application No. GB 0415835.8, Mar. 10, 2005.
Examination Report to Application No. GB 0316887.9, Nov. 25, 2003.
Examination Report to Application No. GB 0406257.6, Jun. 16, 2005.
Examination Report to Application No. GB 0406257.6, Sep. 2, 2005.
Examination Report to Application No. GB 0406258.4, Jul. 27, 2005.
Examination Report to Application No. GB 0411698.4, Jan. 24, 2005.
Examination Report to Application No. GB 0416834.0, Nov. 16, 2004.

Examination Report to Application No. GB 0500184.7, Sep. 12, 2005.
Examination Report to Application No. GB 0500600.2, Sep. 6, 2005.
Examination Report to Application No. GB 0507979.3, Jun. 16, 2005.
Search and Examination Report to Application No. GB 0505039.8, Jul. 22, 2005.
Search and Examination Report to Application No. GB 0506700.4, Sep. 20, 2005.
Search and Examination Report to Application No. GB 0509618.5, Sep. 27, 2005.
Search and Examination Report to Application No. GB 0509620.1, Sep. 27, 2005.
Search and Examination Report to Application No. GB 0509626.8, Sep. 27, 2005.
Search and Examination Report to Application No. GB 0509627.6, Sep. 27, 2005.
Search and Examination Report to Application No. GB 0509629.2, Sep. 27, 2005.
Search and Examination Report to Application No. GB 0509630.0, Sep. 27, 2005.
Search and Examination Report to Application No. GB 0509631.8, Sep. 27, 2005.
Search and Examination Report to Application No. GB 0512396.3, Jul. 26, 2005.
Search and Examination Report to Application No. GB 0512398.9, Jul. 27, 2005.
Search Report to Application No. Norway 1999 5593, Aug. 20, 2002.

* cited by examiner

APPARATUS FOR RADIALLY EXPANDING TUBULAR MEMBERS INCLUDING A SEGMENTED EXPANSION CONE

This application is a National Stage filing based upon PCT application serial no. PCT/US02/24399, filed on Aug. 1, 2002, which claimed the benefit of U.S. provisional application Ser. No. 60/313,453, filed Aug. 20, 2001, the disclosures of which are incorporated herein by reference.

This application is related to the following applications; (1) U.S. patent application Ser. No. 09/454,139, filed on Dec. 3, 1999 now U.S. Pat. No. 6,497,289, (2) U.S. patent application Ser. No. 09/510,913, filed on Feb. 23, 2000, (3) U.S. patent application Ser. No. 09/502,350, filed on Feb. 10, 2000, now U.S. Pat. No. 6,823,937, (4) U.S. patent application Ser. No. 09/440,338, filed on Nov. 15, 1999, now U.S. Pat. No. 6,328,113, (5) U.S. patent application Ser. No. 09/523,460, filed on Mar. 10, 2000, now U.S. Pat. No. 6,640,903, (6) U.S. patent application Ser. No. 09/512,895, filed on Feb. 24, 2000, now U.S. Pat. No. 6,568,471, (7) U.S. patent application Ser. No. 09/511,941, filed on Feb. 24, 2000, now U.S. Pat. No. 6,575,240, (8) U.S. patent application Ser. No. 09/588,946, filed on Jun. 7, 2000, now U.S. Pat. No. 6,557,640, (9) U.S. patent application Ser. No. 09/559,122, filed on Apr. 26, 2000, now U.S. Pat. No. 6,604,763, (10) PCT patent application Ser. No. PCT/US00/18635, filed on Jul. 9, 2000, (11) U.S. provisional patent application Ser. No. 60/162,671, filed on Nov. 1, 1999, (12) U.S. provisional patent application Ser. No. 60/154,047, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, (22) U.S. provisional patent application Ser. No. 60/270,007, filed on Feb. 20, 2001; (23) U.S. provisional patent application Ser. No. 60/262,434, filed on 1/17/2001; (24) U.S. provisional patent application Ser. No. 60/259,486, filed on Jan. 3, 2001; and (25) U.S. provisional patent application Ser. No. 60/303,740, filed on Jul. 6, 2001, the disclosures of which are incorporated herein by reference.

This application is related to the following applications; (1) U.S. Pat. No. 6,497,289, which was filed as U.S. patent application Ser. No. 09/454,139, filed on Dec. 3, 1999, which claims priority from provisional application 60/111,293, filed on Dec. 7, 1998, (2) U.S. patent application Ser. No. 09/510,913, filed on Feb. 23, 2000, which claims priority from provisional application 60/121,702, filed on Feb. 25, 1999, (3) U.S. patent application Ser. No. 09/502,350, filed on Feb. 10, 2000, which claims priority from provisional application 60/119,611, filed on Feb. 11, 1999, (4) U.S. Pat. No. 6,328,113, which was filed as U.S. patent application Ser. No. 09/440,338, filed on Nov. 15, 1999, which claims priority from provisional application 60/108,558, filed on Nov. 16, 1998, (5) U.S. patent application Ser. No. 10/169,434, filed on Jul. 1, 2002, which claims priority from provisional application 60/183,546, filed on Feb. 18, 2000, (6) U.S. Pat. No. 6,640,903 which was filed as U.S. patent application Ser. No. 09/523,468, filed on Mar. 10, 2000, which claims priority from provisional application 60/124,042, filed on Mar. 11, 1999, (7) U.S. Pat. No. 6,568,471, which was filed as patent application Ser. No. 09/512,895, filed on Feb. 24, 2000, which claims priority from provisional application 60/121,841, filed on Feb. 26, 1999, (8) U.S. Pat. No. 6,575,240, which was filed as patent application Ser. No. 09/511,941, filed on Feb. 24, 2000, which claims priority from provisional application 60/121,907, filed on Feb. 26, 1999, (9) U.S. Pat. No. 6,557,640, which was filed as patent application Ser. No. 09/588,946, filed on Jun. 7, 2000, which claims priority from provisional application 60/137,998, filed on Jun. 7, 1999, (10) U.S. patent application Ser. No. 09/981,916, filed on Oct. 18, 2001 as a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (11) U.S. Pat. No.6,604,763, which was filed as application Ser. No. 09/559,122, filed on Apr. 26, 2000, which claims priority from provisional application 60/131,106, filed on Apr. 26, 1999, (12) U.S. patent application Ser. No. 10/030,593, filed on Jan. 8, 2002, which claims priority from provisional application 60/146,203, filed on Jul. 29, 1999, (13) U.S. provisional patent application Ser. No. 60/143,039, filed on Jul. 9, 1999, (14) U.S. patent application Ser. No. 10/111,982, filed on Apr. 30, 2002, which claims priority from provisional patent application Ser. No. 60/162,671, filed on Nov. 1, 1999, (15) U.S. provisional patent application Ser. No. 60/154,047, filed on Sep. 16, 1999, (16) U.S. provisional patent application Ser. No. 60/438,828, filed on Jan. 9, 2003, (17) U.S. patent No. 6,564,875, which was filed as application Ser. No. 09/679,907, on Oct. 5, 2000, which claims priority from provisional patent application No. 60/159,082, filed on Oct. 12, 1999, (18) U.S. patent application Ser. No. 10/089,419, filed on Mar. 27, 2002, which claims priority from provisional patent application Ser. No. 60/159,039, filed on Oct. 12, 1999, (19) U.S. patent application Ser. No. 09/679,906, filed on Oct. 5, 2000, which claims priority from provisional patent application Ser. No. 60/159,033, filed on Oct. 12, 1999, (20) U.S. patent application Ser. No. 10/303,992, filed on Nov. 22, 2002, which claims priority from provisional patent application Ser. No. 60/212,359, filed on Jun. 19, 2000, (21) U.S. provisional patent application Ser. No. 60/165,228, filed on Nov. 12, 1999, (22) U.S. provisional patent application Ser. No 60/455,051, filed on Mar. 14, 2003, (23) PCT application US02/2477, filed on Jun. 26, 2002, which claims priority from U.S. provisional patent application Ser. No. 60/303,711, filed on Jul. 6, 2001, (24) U.S. patent application Ser. No. 10/311,412, filed on Dec. 12, 2002, which claims priority from provisional patent application Ser. No. 60/221,443, filed on Jul. 28, 2000, (25) U.S. patent application Ser. No. 10/322,947, filed on Dec. 18, 2002, which claims priority from provisional patent application Ser. No. 60/221,645, filed on Jul. 28, 2000, (26) U.S. patent application Ser. No. 10/322,947, filed on Jan. 22, 2003, which claims priority from provisional patent application Ser. No. 60/233,638, filed on Sep. 18, 2000, (27) U.S. patent application Ser. No. 10/406,648, filed on Mar. 31, 2003, which claims priority from provisional patent application Ser. No. 60/237,334, filed on Oct. 2, 2000, (28) PCT application US02/04353, filed on Feb. 14, 2002, which claims priority from U.S. provisional patent application Ser. No. 60/270,007, filed on Feb. 20, 2001, (29) U.S. patent application Ser. No. 10/465,835, filed on Jun. 13, 2003, which claims priority from provisional patent application Ser. No. 60/262,434, filed on Jan. 17, 2001, (30) U.S. patent application Ser. No. 10/465,831, filed on Jun. 13, 2003, which claims priority from U.S. provisional patent application Ser. No. 60/259,486, filed on Jan. 3, 2001, (31) U.S. provisional patent application Ser. No. 60/452,303, filed on Mar. 5, 2003, (32) U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Jan. 2, 1998, (33) U.S. Pat. No. 6,561,227, which was filed as patent application Ser. No. 09/852,026, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Dec. 7, 1998, (34) U.S. patent application Ser. No. 09/852,027, filed on May 9, 2001, as a divisional application of U.S. Pat. No. 6,497,289, which was filed as U.S. patent application Ser. No. 09/454,139, filed on Dec. 3, 1999, which claims priority from provisional application 60/111,293, filed on Jan. 2, 1998, (35) PCT Application US02/25608, filed on Aug. 13, 2002, which claims priority from provisional application 60/318,021, filed on Sep. 7, 2001, (36) PCT Application US02/24399, filed on Aug. 1, 2002, which claims priority from U.S. provisional patent application Ser. No. 60/313,453, filed on Aug. 20, 2001, (37) PCT Application US02/29856, filed on Sep. 19, 2002, which claims priority from U.S. provisional patent application Ser. No. 60/326,886, filed on Oct. 3, 2001, (38) PCT Application US02/20256, filed on Jun. 26, 2002, which claims priority from U.S. provisional patent application Ser. No. 60/303,740, filed on Jul. 6, 2001, (39) U.S. patent application Ser. No. 09/962,469, filed on Sep. 25, 2001, which is a divisional of U.S. patent application Ser. No. 09/523,468, filed on Mar. 10, 2000, (now U.S. patent 6,640,903 which issued Nov. 4, 2003), which claims priority from provisional application 60/124,042, filed on Mar. 11, 1999, (40) U.S. patent application Ser. No. 09/962,470, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (41) U.S. patent application Ser. No. 09/962,471, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (42) U.S. patent application Ser. No. 09/962,467, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (43) U.S. patent application Ser. No. 09/962,468, filed on Sep. 25, 2001, which is a divisional of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (44) PCT application US 02/25727, filed on Aug. 14, 2002, which claims priority from U.S. provisional patent application Ser. No. 60/317,985, filed on Sep. 6, 2001, and U.S. provisional patent applicatiion Ser. No. 60/318,386, filed on Sep. 10, 2001, (45) PCT application US 02/39425, filed on Dec. 10, 2002, which claims priority from U.S. provisional patent application Ser. No. 60/343,674, filed on Dec. 27, 2001, (46) U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (47) U.S. utility patent application Ser. No. 10/516,467, filed on Dec. 10, 2001, which is a continuation application of U.S. utility patent application Ser. No. 09/969,922, filed on Oct. 3, 2001, (now U.S. Pat. No. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (48) PCT application US 03/00609, filed on Jan. 9, 2003, which claims priority from U.S. provisional patent application Ser. No. 60/357,372, filed on Feb. 15, 2002, (49) U.S. patent application Ser. No. 10/074,703, filed on Feb. 12, 2002, which is a divisional of U.S. filed as patent application Ser. No. 09/512,895, filed on Feb. 24, 2000, which claims priority from provisional application 60/121,841, filed on Feb. 26, 1999, (50) U.S. patent application Ser. No. 10/074,244, filed on Feb. 12, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (51) U.S. patent application Ser. No. 10/076,660, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (52) U.S. patent application Ser. No. 10/076,661, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (53) U.S. patent application Ser. No. 10/076,659, filed on Feb. 15, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (54) U.S. patent application Ser. No. 10/078,928, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (55) U.S. patent application Ser. No. 10/078,922, attorney docket filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (56) U.S. patent application Ser. No. 10/078,921, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (57) U.S. patent application Ser. No. 10/261,928, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (58) U.S. patent application Ser. No. 10/079,276, filed on Feb. 20, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (59) U.S. patent application Ser. No. 10/262,009, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (60) U.S. patent application Ser. No. 10/092,481, filed on Mar. 7, 2002, which is a divisional of U.S. Pat. No. 6,568,471, which was filed as patent application Ser. No. 09/512,895, filed on Feb. 24, 2000, which claims priority from provisional application 60/121,841, filed on Feb. 26, 1999, (61) U.S. patent application Ser. No. 10/261,926, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (62) PCT application US 02/36157, filed on Nov. 12, 2002, which claims priority from U.S. provisional patent application Ser. No. 60/338,996, filed on Nov. 12, 2001, (63) PCT application US 02/36267, filed on Nov. 12, 2002, which claims priority from U.S. provisional patent application Ser. No. 60/339,013, filed on Nov. 12, 2001, (64) PCT application US 03/11765, filed on Apr. 16, 2003, which claims priority from U.S. provisional patent application Ser. No. 60/383,917, filed on May 29, 2002, (65) PCT application US 03/15020, filed on May 12, 2003, which claims priority from U.S. provisional patent application Ser. No. 60/391,703, filed on Jun. 26, 2002, (66) PCT application US 02/39418, which claims priority from U.S. provisional patent application Ser. No. 60/346,309, filed on Jan. 7, 2002, (67) PCT application US 03/06544, filed on Mar. 4, 2003, which claims priority from U.S. provisional patent application Ser. No. 60/372,048, filed on Apr. 12, 2002, (68) U.S. patent application Ser. No. 10/331,718, filed on Dec. 30, 2002, which is a divisional U.S. patent application Ser. No. 09/679,906, filed on Oct. 5, 2000, which claims priority from provisional patent application Ser. No. 60/159,033, filed on Oct. 12, 1999, (69) PCT application US 03/04837, filed on Feb. 29, 2003, which claims priority from U.S. provisional patent application Ser. No. 60/363,829, filed on Mar. 13, 2002, (70) U.S. patent application Ser. No. 10/261,927, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (71) U.S. patent application Ser. No. 10/262,008, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (72) U.S. patent application Ser. No. 10/261,925, filed on Oct. 1, 2002, which is a divisional of U.S. Pat. No. 6,557,640, which was filed as patent application Ser. No. 09/588,946, filed on Jun. 7, 2000, which claims priority from provisional application 60/137,998, filed on Jun. 7, 1999, (73) U.S. patent application Ser. No. 10/199,524, filed on Jul. 19, 2002, which is a continuation of U.S. Pat. No. 6,497,289, which was filed as U.S. patent application Ser. No. 09/454,139, filed on Dec. 3, 1999, which claims priority from provisional application 60/111,293, filed on Jan. 2, 1998, (74) PCT application US 03/10144, filed on Mar. 28, 2003, which claims priority from U.S. provisional patent application Ser. No. 60/372,632, filed on Apr. 15, 2002, (75) U.S. provisional patent application Ser. No. 60/412,542, filed on Sep. 20, 2002, (76) PCT application US 03/14153, filed on May 6, 2003, which claims priority from U.S. provisional patent application Ser. No. 60/380,147, filed on May 6, 2002, (77) PCT application US 03/19993, filed on Jun. 24, 2003, which claims priority from U.S. provisional patent application Ser. No. 60/397,284, filed on Jul. 19, 2002, (78) PCT application US 03/13787, filed on May 5, 2003, which claims priority from U.S. provisional patent application Ser. No. 60/387,486, filed on Jun. 10, 2002, (79) PCT application US 03/18530, filed on Jun. 11, 2003, which claims priority from U.S. provisional patent application Ser. No. 60/387,961, filed on Jun. 12, 2002, (80) PCT application US 03/20694, which claims priority from U.S. provisional patent application Ser. No. 60/398,061, filed on Jul. 24, 2002, (81) PCT application US 03/20870, filed on Jul. 2, 2003, which claims priority from U.S. provisional patent application Ser. No. 60/399,240, filed on Jul. 29, 2002, (82) U.S. provisional patent application Ser. No. 60/412,487, filed on Sep. 20, 2002, (83) U.S. provisional patent application Ser. No. 60/412,488, filed on Sep. 20, 2002, (84) U.S. patent application Ser. No. 10/280,356, filed on Oct. 25, 2002, which is a continuation of U.S. Pat. No. 6,470,966, which was filed as patent application Ser. No. 09/850,093, filed on May 7, 2001, as a divisional application of U.S. Pat. No. 6,497,289, which was filed as U.S. patent application Ser. No. 09/454,139, filed on Dec. 3, 1999, which claims priority from provisional application 60/111,293, filed on Jan. 2, 1998, (85) U.S. provisional patent application Ser. No. 60/412,177, filed on Sep. 20, 2002, (86) U.S. provisional patent application Ser. No. 60/412,653, filed on Sep. 20, 2002, (87) U.S. provisional patent application Ser. filed on Aug. 23, 2002, (88) U.S. provisional patent application Ser. No. 60/405,394, filed on Aug. 23, 2002, (89) U.S. provisional patent application Ser. No. 60/412,544, filed on Sep. 20, 2002, (90) PCT application US 03/24779, filed on Aug. 8, 2003, which claims priority from U.S. provisional patent application Ser. No. 60/407,442, filed on Aug. 30, 2002, (91) U.S. provisional patent application Ser. filed on Jan. 2, 2002, (92) U.S. provisional patent application Ser. No. 60/412,196, filed on Sep. 20, 2002, (93) U.S. provisional patent application Ser. No. 60/412,187, filed on Sep. 20, 2002, (94) U.S. provisional patent application Ser. No. 60/412,371, filed on Sep. 20, 2002, (95) U.S. patent application Ser. No. 10/382,325, filed on Mar. 5, 2003, which is a continuation of U.S. patent No. 6,557,640, which was filed as patent application Ser. No. 09/588,946, filed on Jun. 7, 2000, which claims priority from provisional application 60/137,998, filed on Jun. 7, 1999, (96) U.S. patent application Ser. No. 10/624,842, filed on Jul. 22, 2003, which is a divisional of U.S. patent application Ser. No. 09/502,350, filed on Feb. 10, 2000, which claims priority from provisional application 60/119,611, filed on Feb. 11, 1999, (97) U.S. provisional patent application Ser. No. 60/431,184, filed on Jan. 2, 2002, (98) U.S. provisional patent application Ser. No. 60/448,526, filed on Feb. 18, 2003, (99) U.S. provisional patent application Ser. No. 60/461,539, filed on Apr. 9, 2003, (100) U.S. provisional patent application Ser. No. 60/462,750, filed on Apr. 14, 2003, (101) U.S. provisional patent application Ser. No. 60/436,106, filed on Jan. 2, 2002, (102) U.S. provisional patent application Ser. No. 60/442,942, filed on Jan. 27, 2003, (103) U.S. provisional patent application Ser. No. 60/442,938, filed on Jan. 27, 2003, (104) U.S. provisional patent application Ser. No 60/418,687, filed on Apr. 18, 2003, (105) U.S. provisional patent application Ser. No. 60/454,896, filed on Mar. 14, 2003, (106) U.S. provisional patent application Ser. No. 60/450,504, filed on Feb. 26, 2003, (107) U.S. provisional patent application Ser. No. 60/451,152, filed on Mar. 9, 2003, (108) U.S. provisional patent application Ser. No. 60/455,124, filed on Mar. 17, 2003, (109) U.S. provisional patent application Ser. No. 60/453,678, filed on Mar. 11, 2003, (110) U.S. patent application Ser. No. 10/421,682, filed on Apr. 23, 2003, which is a continuation of U.S. patent application Ser. No. 09/523,468, filed on Mar. 10, 2000, (now U.S. Pat. No. 6,640,903 which issued Nov. 4, 2003), which claims priority from provisional application 60/124,042, filed on Mar. 11, 1999, (111) U.S. provisional patent application Ser. No. 60/457,965, filed on Mar. 27, 2003, (112) U.S. provisional patent application Ser. No. 60/455,718, filed on Mar. 18, 2003, (113) U.S. Pat. No. 6,550,821, which was filed as patent application Ser. No. 09/811,734, filed on Mar. 19, 2001, (114) U.S. patent application Ser. No. 10/436,467, filed on May 12, 2003, which is a continuation of U.S. Pat. No. 6,604,763, which was filed as application Ser. No. 09/559,122, filed on Apr. 26, 2000, which claims priority from provisional application 60/131,106, filed on Apr. 26, 1999, (115) U.S. provisional patent application Ser. No. 60/459,776, filed on Apr. 2, 2003, (116) U.S. provisional patent application Ser. No. 60/461,094, filed on Apr. 8, 2003, (117) U.S. provisional patent application Ser. No. 60/461,038, filed on Apr. 7, 2003, (118) U.S. provisional application Ser. No. 60/463,586, filed on Apr. 17, 2003, (119) U.S. provisional patent application Ser. No. 60/472,240, filed on May 20, 2003, (120) U.S. patent application Ser. No. 10/619,285, filed on Jul. 14, 2003, which is a continuation-in-part of U.S. utility patent application Ser. No. 09/969,922, filed on Oct. 3, 2001, (now U.S. Pat. 6,634,431 which issued Oct. 21, 2003), which is a continuation-in-part application of U.S. Pat. No. 6,328,113, which was filed as U.S. patent application Ser. No. 09/440,338, filed on Nov. 15, 1999, which claims priority from provisional application 60/108,558, filed on Nov. 16, 1998, (121) U.S. utility patent application Ser. No. 10/418,688, which was filed on Apr. 18, 2003, as a division of U.S. utility patent application Ser. No. 09/523,468, filed on Mar. 10, 2000. (now U.S. Pat. No. 6,640,903 which issued Nov. 4, 2003), which claims priority from provisional application 60/124,042, filed on Mar. 11, 1999; (122) PCT patent application Ser. No. PCT/US2004/06246, filed on Feb. 26, 2004; (123) PCT patent application Ser. No. PCT/US2004/08170, filed on Mar. 15, 2004; (124) PCT patent application Ser. No. PCT/US2004/08171, filed on Mar. 15, 2004; (125) PCT patent application Ser. No. PCT/US2004/08073, filed on Mar. 18, 2004; (126) PCT patent application Ser. No. PCT/US2004/07711, filed on Mar. 11, 2004; (127) PCT patent application Ser. No. PCT/US2004/029025, filed on Mar. 26, 2004; (128) PCT patent application Ser. No. PCT/US2004/010317, filed on Apr. 2, 2004; (129) PCT patent application Ser. No. PCT/US2004/010712, filed on Apr. 6, 2004; (130) PCT patent application Ser. No. PCT/US2004/010762, filed on Apr. 6, 2004; (131) PCT patent application Ser. No. PCT/US2004/011973, filed on Apr. 15, 2004; (132) U.S. provisional patent application Ser. No. 60/495056, filed on Aug. 14, 2003; (133) U.S. provisional patent application Ser. No. 60/600679, filed on Aug. 11, 2004; (134) PCT patent application Ser. No. PCT/US2005/027318, filed on Jul. 29, 2005; (135) PCT patent application Ser. No. PCT/US2005/028936, filed on Aug. 12, 2005; (136) PCT patent application Ser. No. PCT/US2005/028669, filed on Aug. 11, 2005; (137) PCT patent application Ser. No. PCT/US2005/028453, filed on Aug. 11, 2005; (138) PCT patent application Ser. No. PCT/US2005/028641, filed on Aug. 11, 2005; (139) PCT patent application Ser. No. PCT/US2005/028819, filed on Aug. 11, 2005; (140) PCT patent application Ser. No. PCT/US2005/028446, filed on Aug. 11, 2005; (141) PCT patent application Ser. No. PCT/US2005/028642, filed on Aug. 11, 2005; (142) PCT patent application Ser. No. PCT/US2005/028451, filed on Aug. 11, 2005, and (143), PCT patent application Ser. No. PCT/US2005/028473, filed on Aug. 11, 2005, (144) U.S. utility patent application Ser. No. 10/546082, filed on Aug. 16, 2005, (145) U.S. utility patent application Ser. No. 10/546076, filed on Aug. 16, 2005, (146) U.S. utility patent application Ser. No. 10/545936, filed on Aug. 16, 2005, (147) U.S. utility patent application Ser. No. 10/546079, filed on Aug. 16, 2005(148) U.S. utility patent application Ser. No. 10/545941, filed on Aug. 16, 2005, (149) U.S. utility patent application Ser. No. 546078, filed on Aug. 16, 2005, filed on Aug. 11, 2005, (150) U.S. utility patent application Ser. No. 10/545941, filed on Aug. 16, 2005, (151) U.S. utility patent application Ser. No. 11/249967, filed on Oct. 13, 2005, (152) U.S. provisional patent application Ser. No. 60/734302, filed on Nov. 7, 2005, (153) U.S. provisional patent application Ser. No. 60/725181, filed on Oct. 11, 2005, (154) PCT patent application Ser. No. PCT/US2005/023391, filed Jun. 29, 2005 which claims priority from U.S. provisional patent application Ser. No. 60/585370, filed on Jul. 2, 2004, (155) U.S. provisional patent application Ser. No. 60/721579, filed on Sep. 28, 2005, (156) U.S. provisional patent application Ser. No. 60/717391, filed on Sep. 15, 2005, (157) U.S. provisional patent application Ser. No. 60/702935, filed on Jul. 27, 2005, (158) U.S. provisional patent application Ser. No. 60/663913, filed on Mar. 21, 2005, (159) U.S. provisional patent application Ser. No. 60/652564, filed on Feb. 14, 2005, (160) U.S. provisional patent application Ser. No. 60/645840, filed on Jan. 21, 2005, (161) PCT patent application Ser. No. PCT/US2005/043122, filed on Nov. 29, 2005 which claims priority from U.S. provisional patent application Ser. No. 60/631703, filed on Nov. 30, 2004, (162) U.S. provisional patent application Ser. No. 60/752787, filed on Dec. 22, 2005, (163) U.S. National Stage application Ser. No. 10/548934, filed on Sep. 12, 2005; (164) U.S. National Stage application Ser. No. 10/549410, filed on Sep. 13, 2005; (165) U.S. Provisional Patent Application No. 60/717391, filed on Sep. 15, 2005; U.S. National Stage application Ser. No. 10/550906, filed on Sep. 27, 2005; (167) U.S. National Stage application Ser. No. 10/551880, filed on Sep. 30, 2005; (168) U.S. National Stage application Ser. No. 10/552253, filed on Oct. 4, 2005; (169) U.S. National Stage application Ser. No. 10/552790, filed on Oct. 11, 2005; (170) U.S. Provisional Patent Application No. 60/725181, Oct. 11, 2005; (171) U.S. National Stage application Ser. No. 10/553094, filed on Oct. 13, 2005; (172) U.S. National Stage application Ser. No. 10/553566, filed on Oct. 17, 2005; (173) PCT patent Application No. PCT/US2006/002449, Jan. 20, 2006, and (174) PCT patent Application No. PCT/US2006/004809, filed on Feb. 9, 2006, (175) U.S. Utility patent application Ser. No. 11/356899, filed on Feb. 17, 2006, (176) U.S. National Stage application Ser. No. 10/568200, filed on Feb. 13, 2006, (177) U.S. National Stage application Ser. No. 10/568719, filed on Feb. 16, 2006, (178) U.S. National Stage application Ser. No. 10/569323, (179) U.S. National Stage patent application Ser. No. filed on Mar. 3, 2006; (180) U.S. National State patent application Ser. No. 10/571017, filed on Mar. 3, 2006; (181) U.S. National Stage patent application Ser. No. 10/571086, filed on Mar. 6, 2006; and (182) U.S. National Stage patent application Ser. No. 10/571085, filed on Mar. 6, 2006, (183) U.S. utility patent application Ser. No. 10/938788, filed on Sep. 10, 2004, (184) U.S. utility patent application Ser. No. 10/938225, filed on Sep. 10, 2004, (185) U.S. utility patent application Ser. No. 10/952288, filed on Sep. 28, 2004, (186) U.S. utility patent application Ser. No. 10/952416, filed on Sep. 28, 2004, (187) U.S. utility patent application Ser. No.

10/950749, filed on Sep. 27, 2004, and (188)U.S. utility patent application Ser. No. 10/950869, filed on Sep. 27, 2004.

BACKGROUND

BACKGROUND OF THE INVENTION

This invention relates generally to wellbore casings, and in particular to wellbore casings that are formed using expandable tubing.

DETAILED DESCRIPTION OF THE ILLUSTRATIVE EMBODIMENTS

Figure 1A:
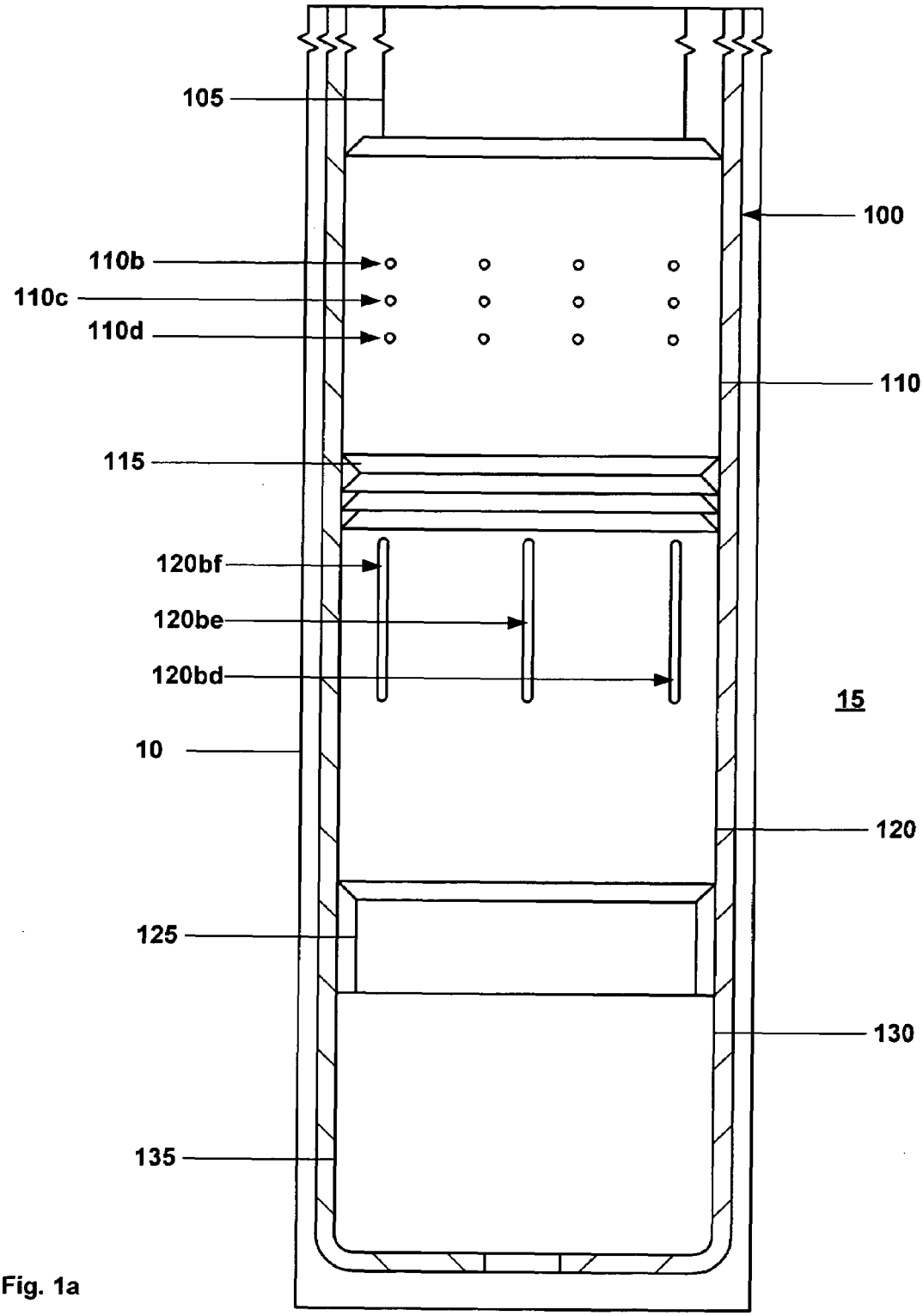
FIGS. 1*a*–1*h* are fragmentary cross-sectional illustrations of an embodiment of the placement of an apparatus for radially expanding a tubular member within a borehole within a subterranean formation.
Figure 1B:
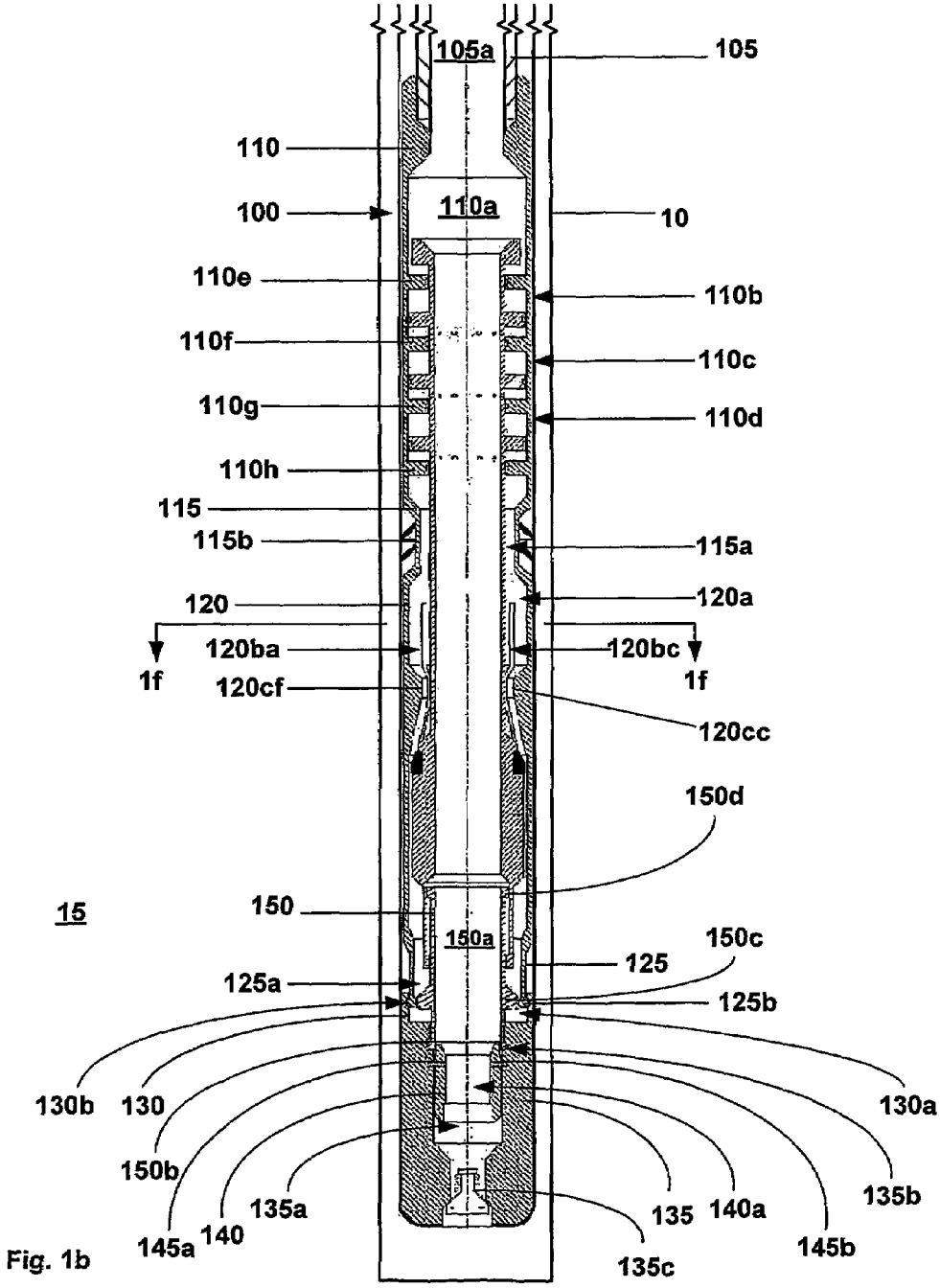
Figure 1C:
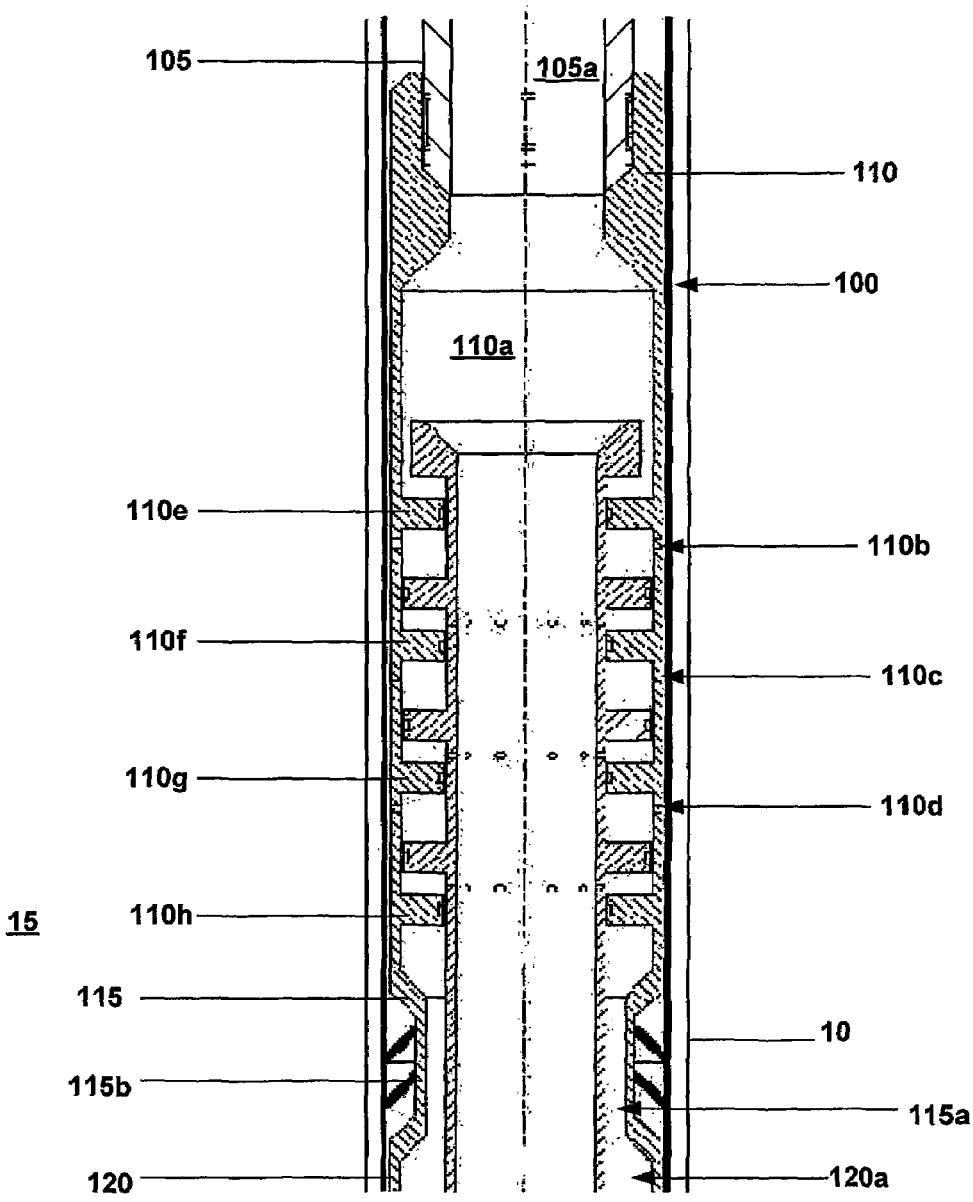
Figure 1D:
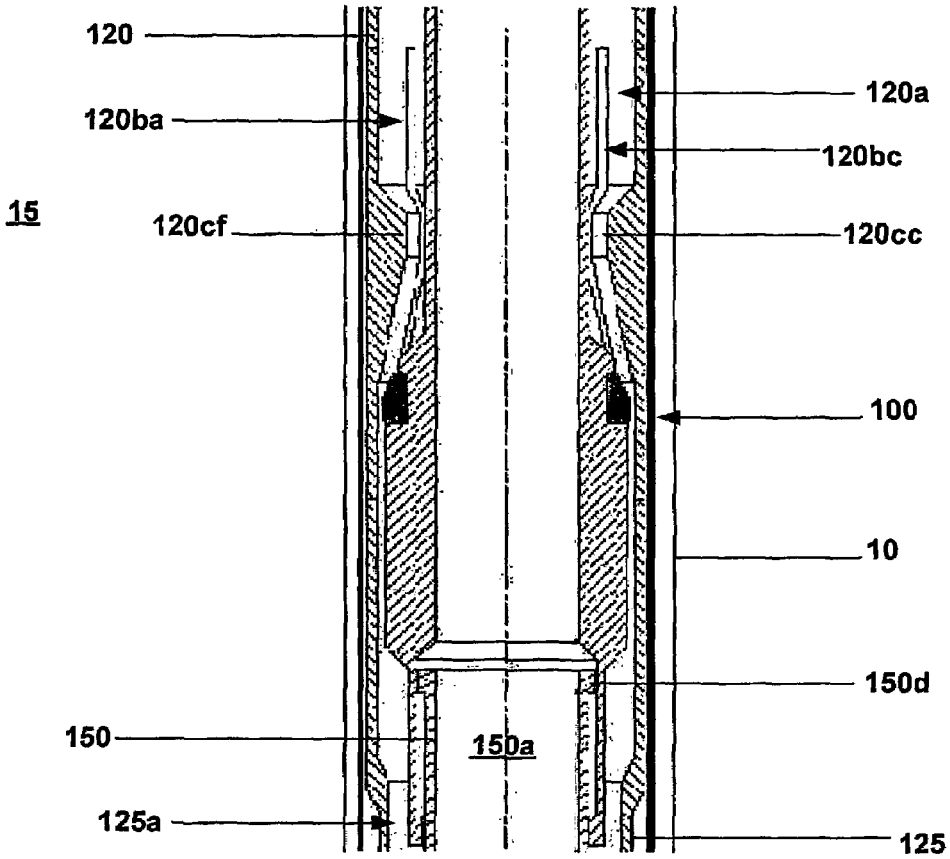
Figure 1E:
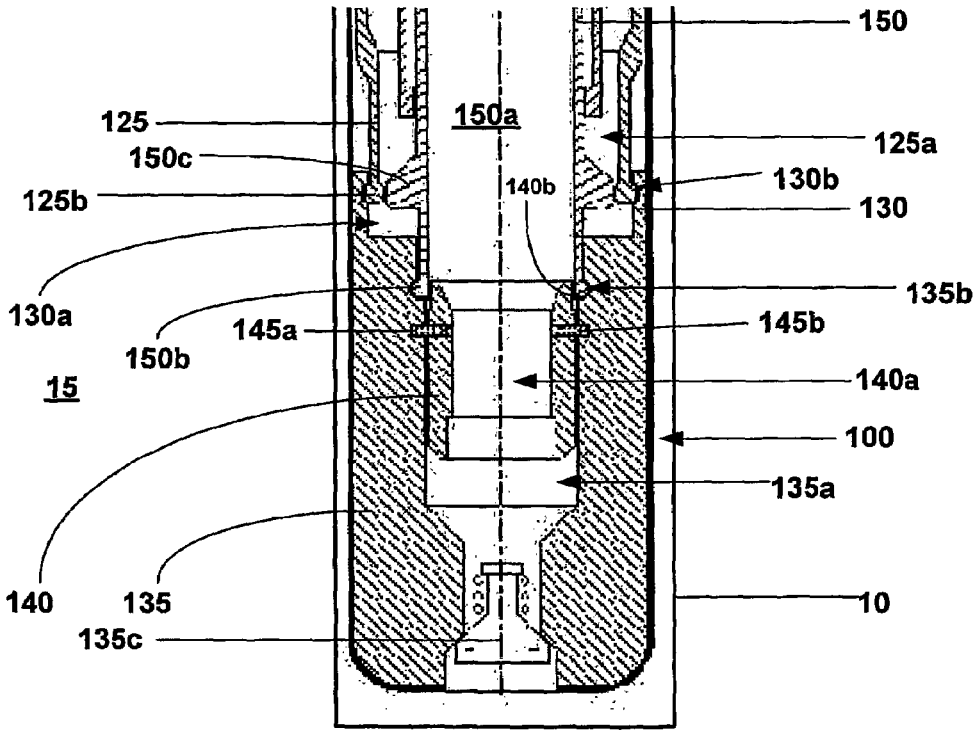
Figure 1F:
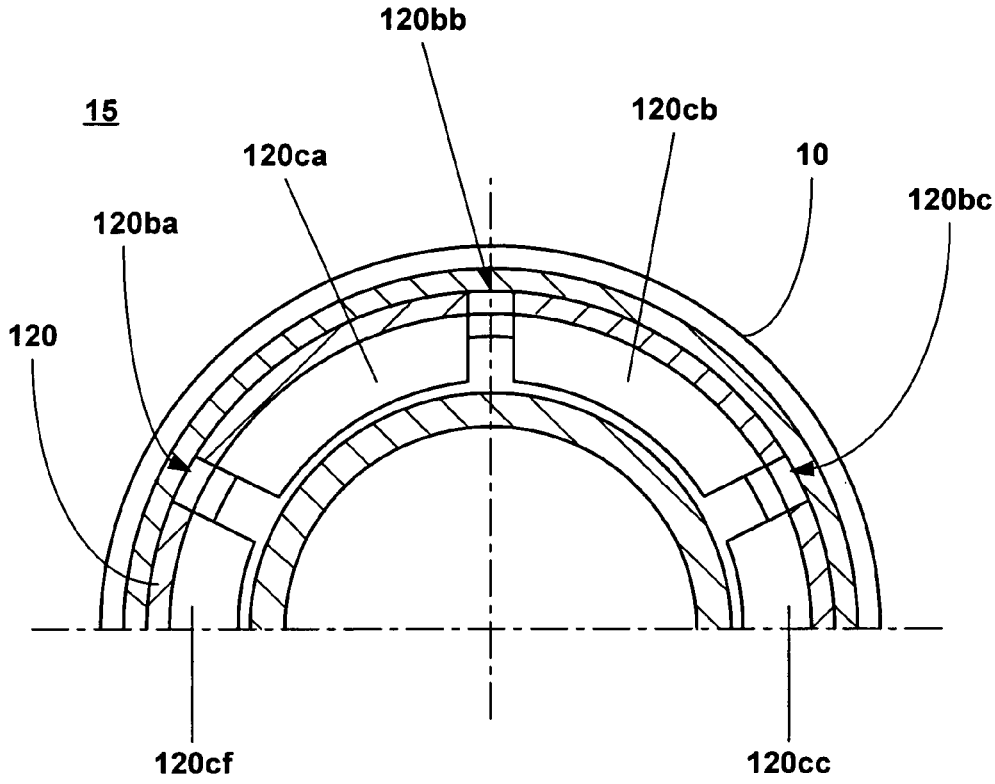
Figure 1G:
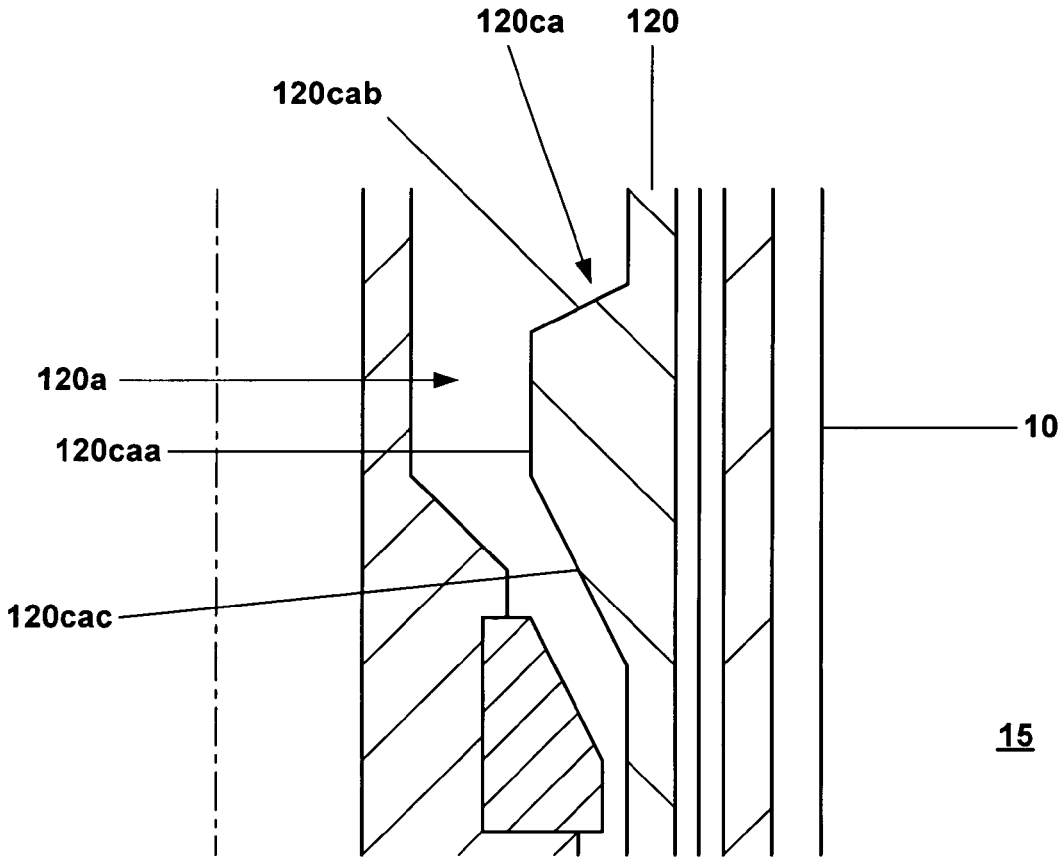
Figure 1H:
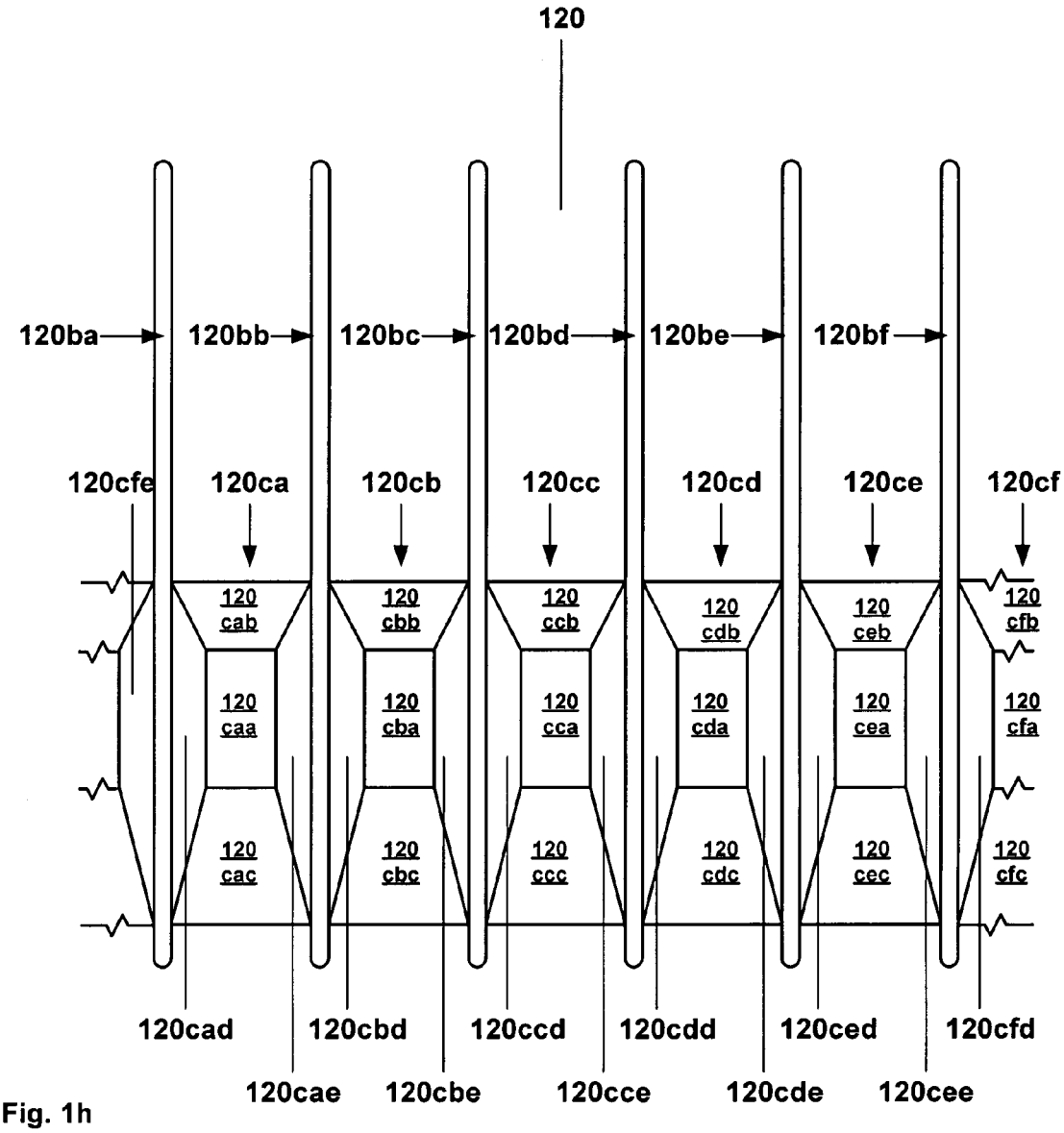

Referring initially to FIGS. 1*a*–1*h*, an embodiment of an apparatus and method for radially expanding a tubular member will now be described. As illustrated in FIGS. 1*a*-1*h*, a wellbore 10 is positioned in a subterranean formation 15.

An apparatus 100 for radially expanding a tubular member may then be positioned within the wellbore 10 that includes a tubular support member 105 that defines a passage 105*a*. An end of the tubular support member 105 is coupled to an end of a tubular support member 110 that defines a passage 110*a*, a plurality of spaced apart radial passages 110*b*, 110*c*, and 110*d*, and includes a plurality of spaced apart internal flanges 110*e*, 110*f*, 110*g*, and 100*h* that are interleaved among the radial passages. The spaced apart radial passages 110*b*, 110*c*, and 110*d* may each include a plurality of radial passages distributed around the tubular support member 110 in the circumferential direction. Another end of the tubular support member 110 is coupled to an end of a tubular support member 115 that defines a passage 115*a* and includes a centrally positioned recessed portion 115*b*.

An end of a tubular support member 120 is coupled to another end of the tubular support member 115 that defines a passage 120*a* and a plurality of longitudinal slots 120*ba*, 120*bb*, 120*bc*, 120*bd*, 120*be*, and 120*bf*, and includes a plurality of internal arcuate expansion cone segments 120*ca*, 120*cb*, 120*cc*, 120*cd*, 120*ce*, and 120*cf*. The expansion cone segments, 120*ca*, 120*cb*, 120*cc*, 120*cd*, 120*ce*, and 120*cf* extend inwardly from the tubular support member 120 in the radial direction and include: (a) arcuate cylindrical segment end faces, 120*caa*, 210*cba*, 120*cca*, 120*cda*, 120*cea*, and 120*cfa*, that are substantially parallel to the longitudinal axis of the tubular support member, (b) upper inclined trapezoidal faces, 120*cab*, 120*cbb*, 120*ccb*, 120*cdb*, 120*ceb*, and 120*cfb*, that extend upwardly from the upper ends of the corresponding end faces to the tubular support member, (c) lower inclined trapezoidal faces, 120*cac*, 120*cbc*, 120*ccc*, 120*cdc*, 120*cec*, and 120*cfc*, that extend downwardly from the lower ends of the corresponding end faces to the tubular support member, (d) side trapezoidal faces, 120*cad*, 120*cbd*, 120*ccd*, 120*cdd*, 120*ced*, and 120*cfd*, that extend from the sides of the corresponding end faces to the tubular support member, and (3) side trapezoidal faces, 120*cae*, 120*cbe*, 120*cce*, 120*cde*, 120*cee*, and 120*cfe*, that extend from the other sides of the corresponding end faces to the tubular support member. In an exemplary embodiment, the angle between the upper inclined trapezoidal faces, 120*cab*, 120*cbb*, 120*ccb*, 120*cdb*, 120*ceb*, and 120*cfb*, and the longitudinal direction is greater than the angle between the lower inclined trapezoidal faces, 120*cac*, 120*cbc*, 120*ccc*, 120*cdc*, 120*cec*, and 120*cfc*, and the longitudinal direction, respectively, in order to optimally provide radial expansion of the expansion cone segments. In an exemplary embodiment, the side faces, 120*cae* and 120*cbd*, 120*cbe* and 120*ccd*, 120*cce* and 120*cdd*, 120*cde* and 120*ced*, 120*cee* and 120*cfd*, and 120*cfe* and 120*cad* are substantially parallel in order to optimally provide a substantially continuous outer surface after the radial expansion of the expansion cone segments 120*ca*, 120*cb*, 120*cc*, 120*cd*, 120*ce*, and 120*cf*.

An end of a tubular locking collet 125 is coupled to the other end of the other end of the tubular support member 120 that defines a passage 125*a* and includes a plurality of resilient locking collet members 125*b*. A tubular retaining member 130 that defines a passage 130*a* includes an internal recessed portion 130*b* at an end that is adapted to mate with and receive at least a portion of the locking collet members 125*b* of the tubular locking collet 125. Another end of the tubular retaining member 130 is coupled to an end of a shoe 135 that defines a passage 135*a* and an internal recess 135*b* and includes a conventional float valve 135*c* at an opposite end that permits fluids to be exhausted from the passage 135*a* outside of the apparatus 100 but prevents the flow of fluids into the passage and inside the apparatus.

A tubular dart seat 140 that defines a passage 140*a* and includes a recessed portion 140*b* is received within the passage 135*a* of the shoe 135 and is releasably coupled to the shoe by shear pins 145*a* and 145*b*. A tubular locking sleeve 150 that defines a passage 150*a* includes a locking member 150*b* that is received within and mates with the recesses, 135*b* and 140*b*, of the shoe 135 and dart seat 140, respectively, a conical locking flange 150*c* that locks the locking collet members 125*b* of the tubular locking collet 125 within the recessed portion 130*b* of the tubular retaining member 130, and an external flange 150*d*.

A tubular tension sleeve 155 is received within the tubular support members 110, 115, and 120, and the tubular locking collet 125 that defines a longitudinal passage 155*a* and longitudinally spaced radial passages 155*b*, 155*c*, and 155*d* includes a recessed portion 155*e* for movably receiving an end of the tubular locking sleeve 150, an internal flange 155*f* for engaging the external flange 150*d* of the tubular locking sleeve, an external flange 155*g* having a recessed portion 155*ga*, and longitudinally spaced apart external flanges 155*h*, 155*i*, and 155*j*. In an exemplary embodiment, each of the radial passages 155*b*, 155*c*, and 155*d* include a plurality of circumferentially spaced apart radial passages. In an exemplary embodiment, the external flanges 155*h*, 155*i*, and 155*j* are interleaved with the radial passages 155*b*, 155*c*, and 155*d*. In an exemplary embodiment, the external flanges 155*h*, 155*i*, and 155*j* are also interleaved with the internal flanges, 110*e*, 110*f*, 110*g*, and 110*h* of the tubular support member 110. In this manner, the internal flanges 110*e*, 110*f*, 110*g*, and 110*h* of the tubular support member 110 and the external flanges 155*h*, 155*i*, and 155*j* of the tubular tension sleeve 155 define annular chambers 160*a*, 160*b*, 160*c*, 160*d*, 160*e*, and 160*f*.

A tubular internal expansion cone 165 is received within and coupled to the recessed portion 155*ga* of the external flange 155*g* of the tubular tension sleeve 155. Cup seals 170*a* and 170*b* are coupled to the exterior of the recessed portion 115*b* of the tubular support member 115. An end of an expandable tubular member 175 is coupled to the shoe 135 for receiving the tubular support members 105, 110, 115, 120, and the tubular locking collet 125. The annulus between the tubular support member 115 and the expandable tubular member 175 is fluidicly sealed by the cup seals, 170*a* and 170*b*.

As illustrated in FIGS. 1*a*–1*h*, the apparatus 100 is initially positioned within the wellbore 10 within the subterranean formation 15. The wellbore 10 may be vertical, horizontal, or any orientation in between. Furthermore, the wellbore 10 may be a tunnel for receiving a pipeline or a borehole for receiving a structural support. In addition, the wellbore 10 may include a preexisting wellbore casing.

Figure 2:
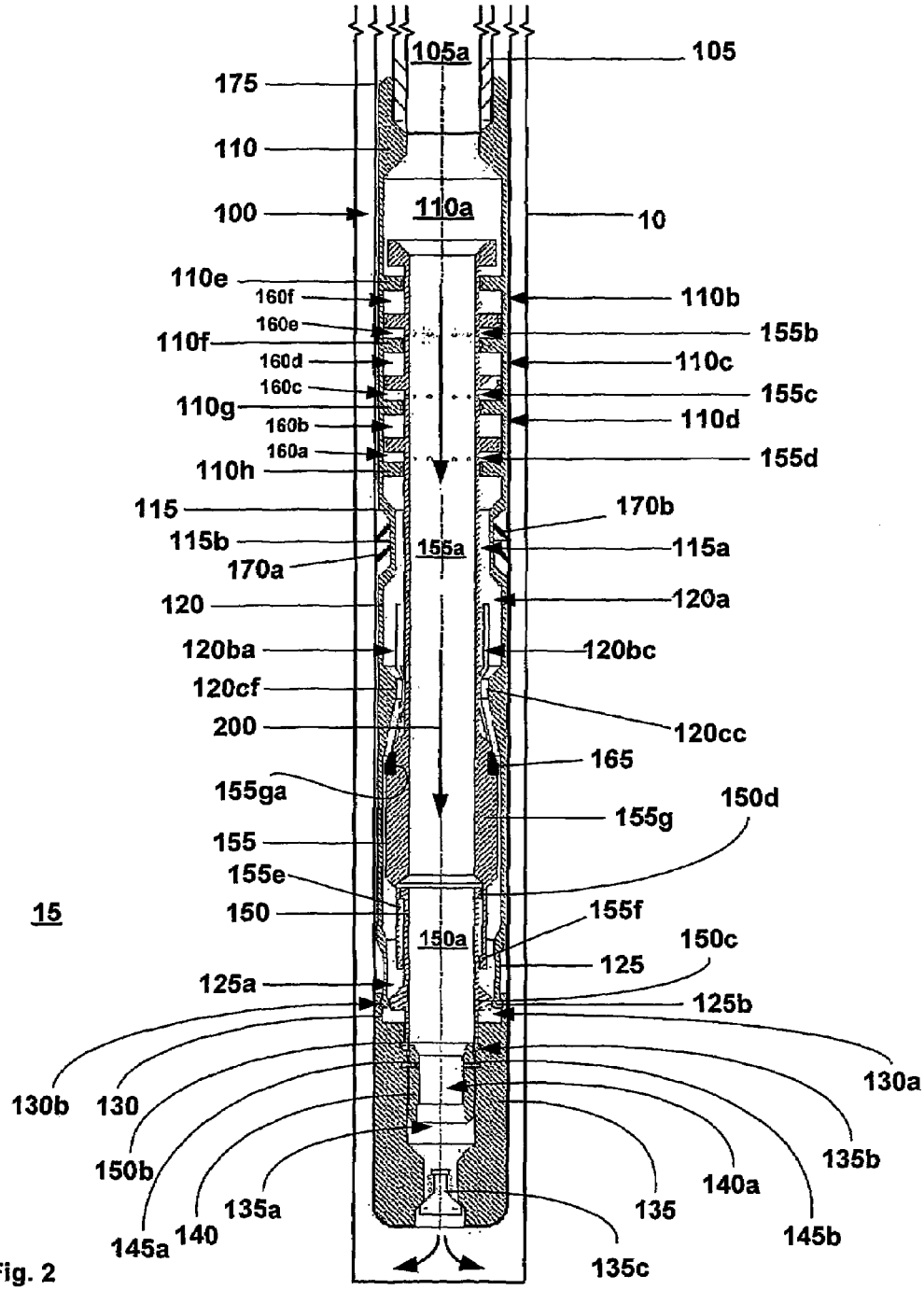
FIG. 2 is a fragmentary cross-sectional illustration of the injection of a hardenable fluidic sealing material into the apparatus of FIGS. 1*a*–1*h*.

As illustrated in FIG. 2, a hardenable fluidic sealing material 200 may then be injected into the apparatus 100 through the passages 105*a*, 110*a*, 155*a*, 150*a*, 140*a*, and 135*a* out of the float valve 135*c* into the annulus between the expandable tubular member 175 and the interior surface of the wellbore 10. In this manner, an annular layer of a sealing material may be formed around the expandable tubular member 175. In several alternative embodiments, the annular layer of the fluidic sealing material may be cured before or after radially expanding the expandable tubular member 175.

Figure 3:
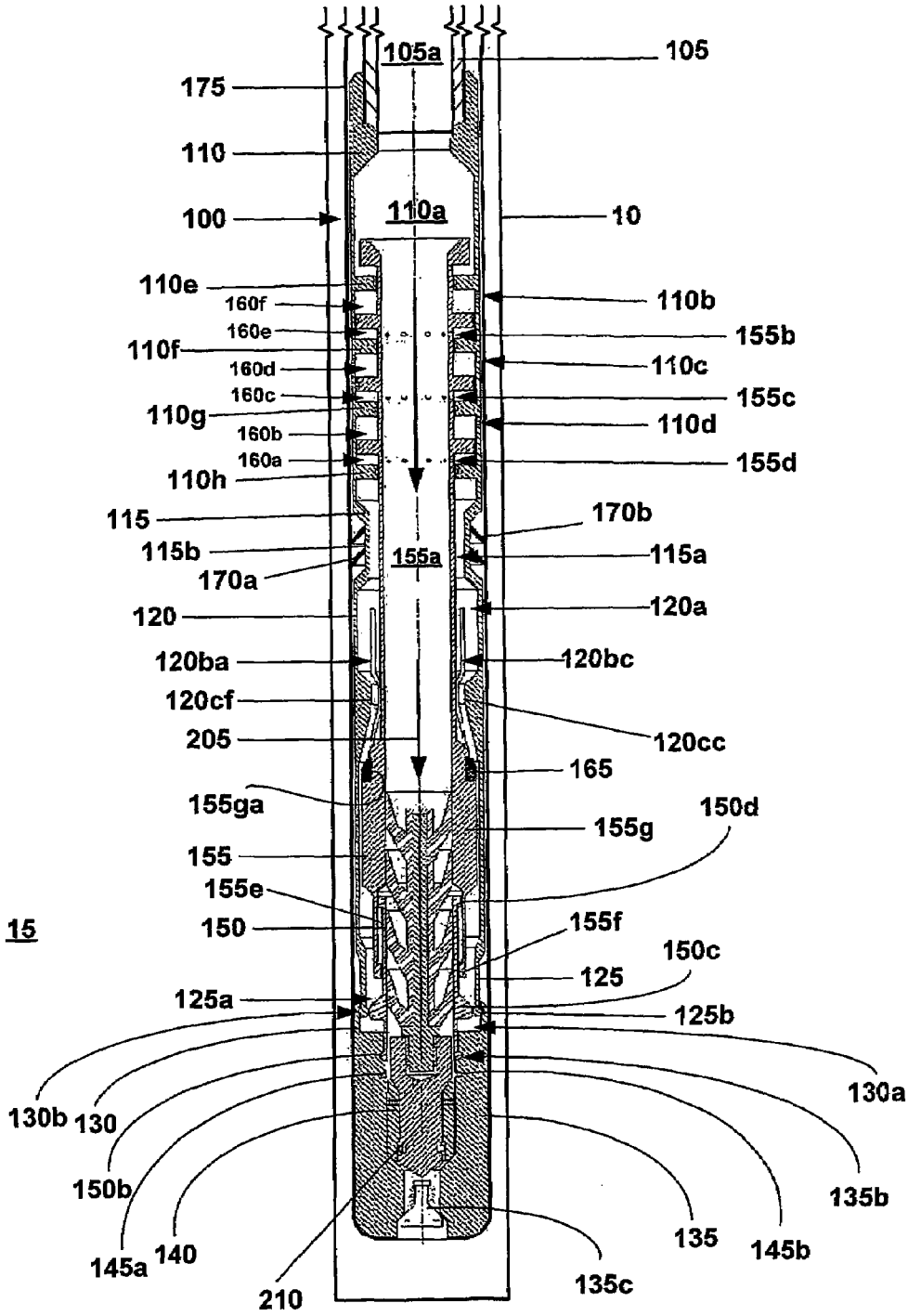
FIG. 3 is a fragmentary cross-sectional illustration of the apparatus of FIG. 2 after injecting a fluidic material into the apparatus and seating a dart in the tubular dart seat.

As illustrated in FIG. 3, a fluidic material 205 may be injected into the apparatus 100 through the passages 105*a*, 110*a*, 155*a*, 150*a*, 140*a*, and 135*a*. A conventional dart 210 may then be seated within the tubular dart seat 140 by introducing the dart into the injected fluidic material 205. Continued injection of the fluidic material 205 may then pressurize the passages 105*a*, 110*a*, and 155*a* thereby increasing the operating pressure in the passages and applying an axial downward force to the dart 210. As a result, the shear pins 145*a* and 145*b* may be sheared and the tubular dart seat 140 and the dart 210 may shift downward towards the float valve 135*c*. As a result, the locking member 150*b* of the tubular locking sleeve 150 may no longer be locked into the recess 135*b* of the shoe 135 by the tubular dart seat 140.

Figure 4:
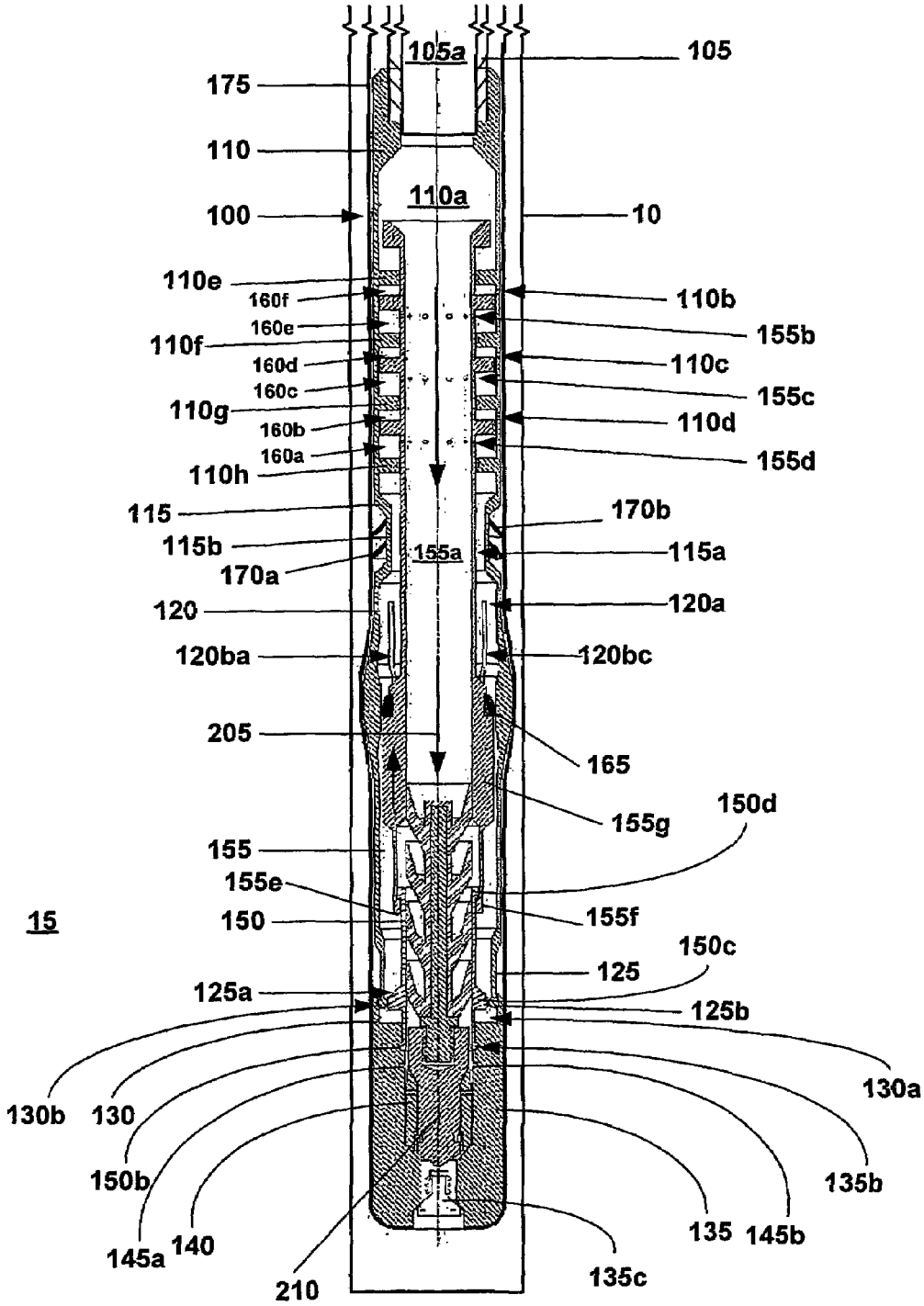
FIG. 4 is a fragmentary cross-sectional illustration of the apparatus of FIG. 3 after continuing to inject a fluidic material into the apparatus thereby axially displacing the tension sleeve and thereby creating a segmented expansion cone for plastically deforming and radially expanding the expandable tubular member using the expansion segments.

As illustrated in FIG. 4, continued injection of the fluidic material 205 may pressurize the passages 105*a*, 110*a*, and 155*a* thereby pressurizing and expanding the annular pressure chambers, 160*a*, 160*c*, and 160*e*. As a result, the tubular tension sleeve 155 may be displaced in the upward axial direction thereby driving the tubular internal expansion cone 165 into contact with the lower inclined trapezoidal faces 120*cac*, 120*cbc*, 120*ccc*, 120*cdc*, 120*cec*, and 120*cfc* of the expansion cone segments 120*ca*, 120*cb*, 120*cc*, 120*cd*, 120*ce*, and 120*cf*, respectively, of the tubular support member 120. As a result, the expansion cone segments 120*ca*, 120*cb*, 120*cc*, 120*cd*, 120*ce*, and 120*cf* of the tubular support member 120 are driven outwardly in the radial direction and the expandable tubular member 175 is thereby radially expanded and plastically deformed. In this manner, a segmented expansion cone for plastically deforming and radially expanding the expandable tubular member 175 may be formed within the wellbore 10 that includes the radially expanded expansion cone segments expansion cone segments 120*ca*, 120*cb*, 120*cc*, 120*cd*, 120*ce*, and 120*cf* of the tubular support member 120.

Figure 5:
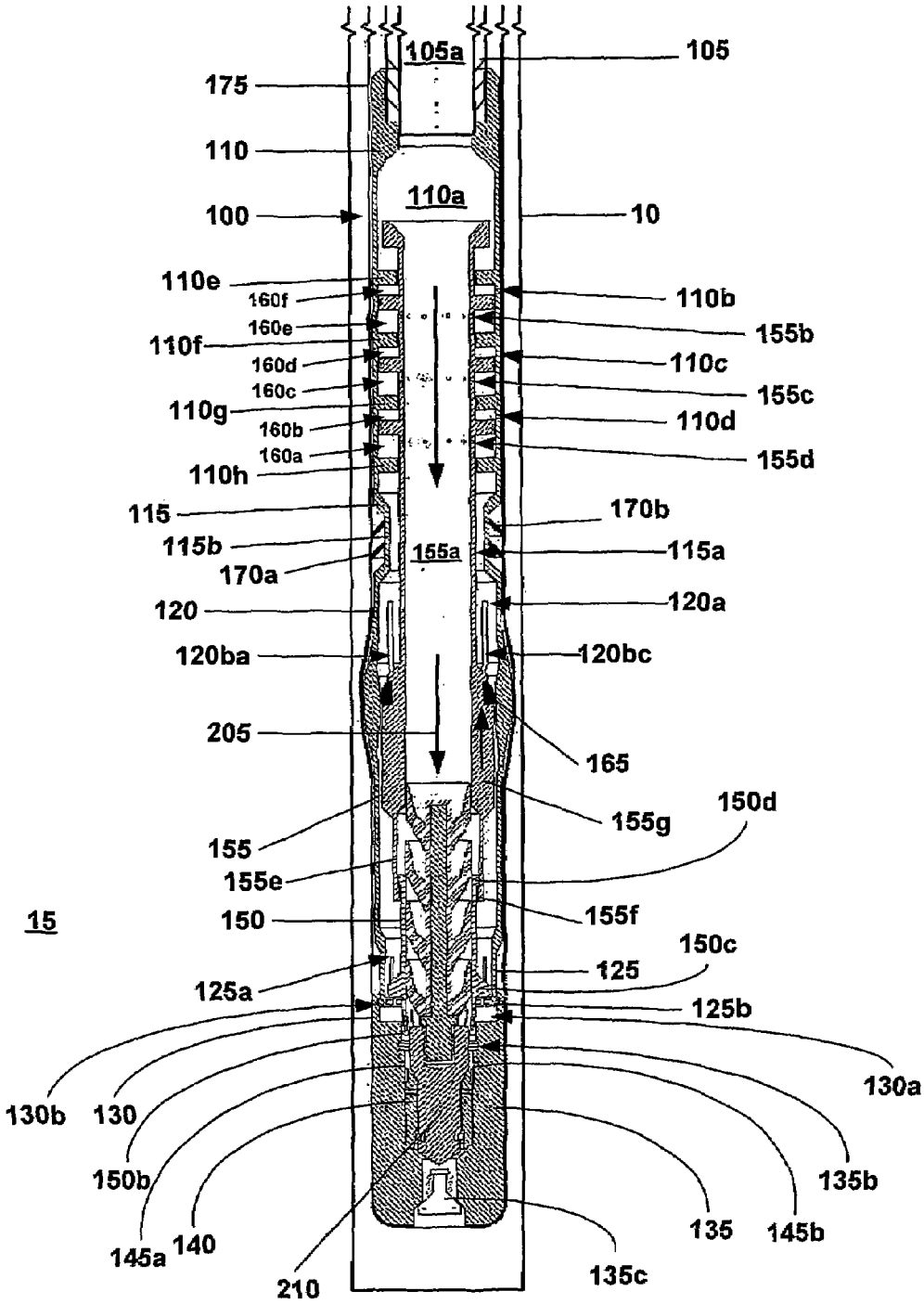
FIG. 5 is a fragmentary cross-sectional illustration of the apparatus of FIG. 4 after continuing to inject a fluidic material into the apparatus thereby displacing the tubular locking sleeve from engagement with the locking member of the tubular locking collet.

As illustrated in FIG. 5, continued injection of the fluidic material 205 may further pressurize the passages 105*a*, 110*a*, and 155*a*, thereby further pressurizing and expanding the annular pressure chambers, 160*a*, 160*c*, and 160*e*. As a result, the tubular tension sleeve 155 may be further displaced in the upward axial direction thereby causing the internal flange 155*f* of the tubular tension sleeve to engage the external flange 150*d* of the tubular locking sleeve 150. As a result, the tubular locking sleeve 150 may be upwardly displaced in the axial direction thereby releasing the conical locking flange 150*c* of the tubular locking sleeve from engagement with the locking collet members 125*b* of the tubular locking collet 125. As a result, the locking collet members 125*b* of the tubular locking collet 125 may be disengaged from the recessed portion 130*b* of the tubular retaining member 130. At this point the tubular locking collet 125 and the tubular locking sleeve 150 are no longer engaged with the tubular retaining member 130 and the shoe 135.

Figure 6:
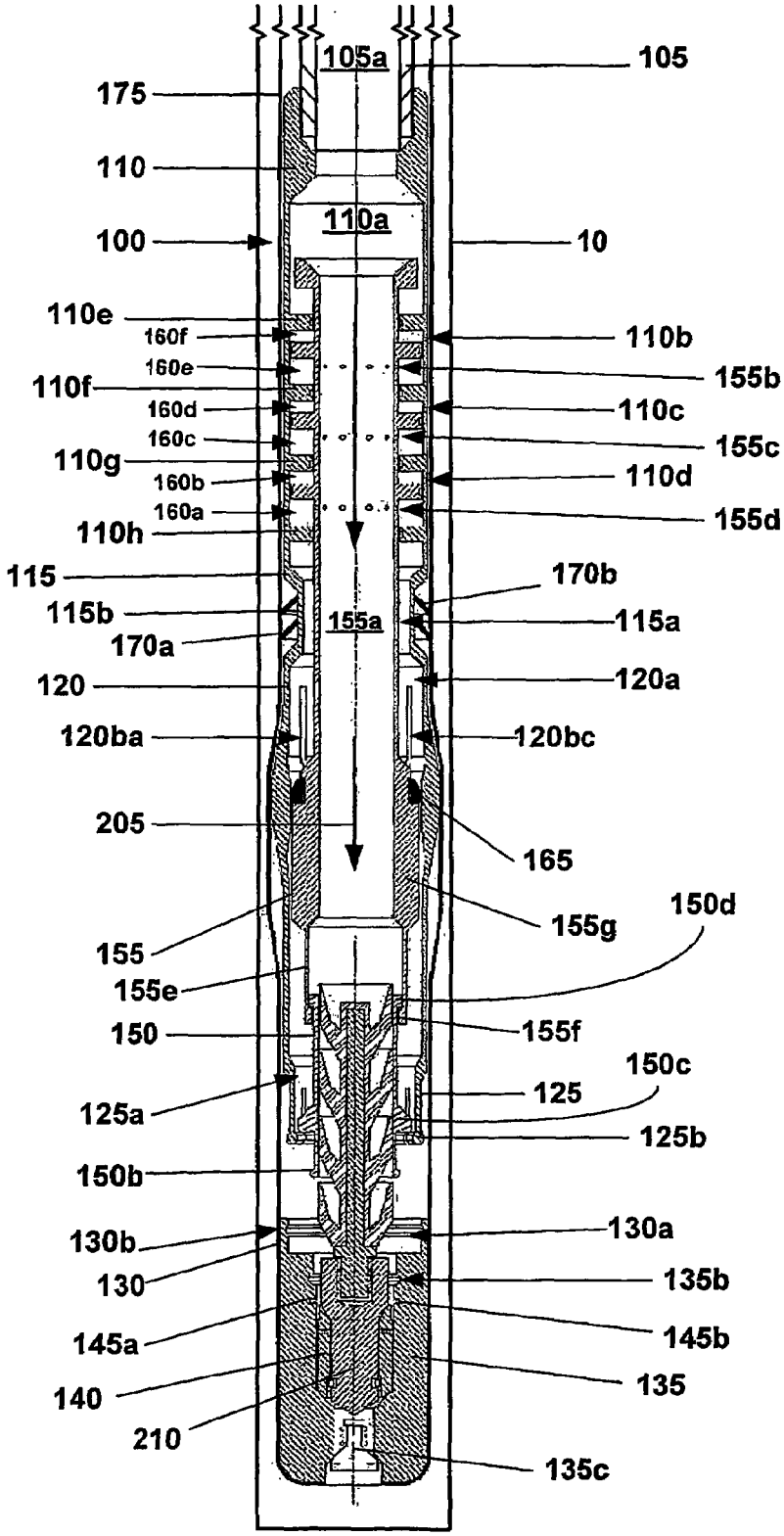
FIG. 6 is a fragmentary cross-sectional illustration of the apparatus of FIG. 5 after continuing to inject a fluidic material into the apparatus thereby displacing the tubular support members, the tubular locking collet, the tubular locking sleeve, and the tubular tension sleeve upwardly in the axial direction thereby further plastically deforming and radially expanding the expandable tubular member.

As illustrated in FIG. 6, continued injection of the fluidic material 205 may further pressurize the passages 105*a*, 110*a*, and 155*a*. As a result, the tubular support members 105, 110, 115, and 120, the tubular locking collet 125, the tubular locking sleeve 150, and the tubular tension sleeve 155 may be displaced upwardly in the axial direction thereby further plastically deforming and radially expanding the expandable tubular member 175.

Figure 7:
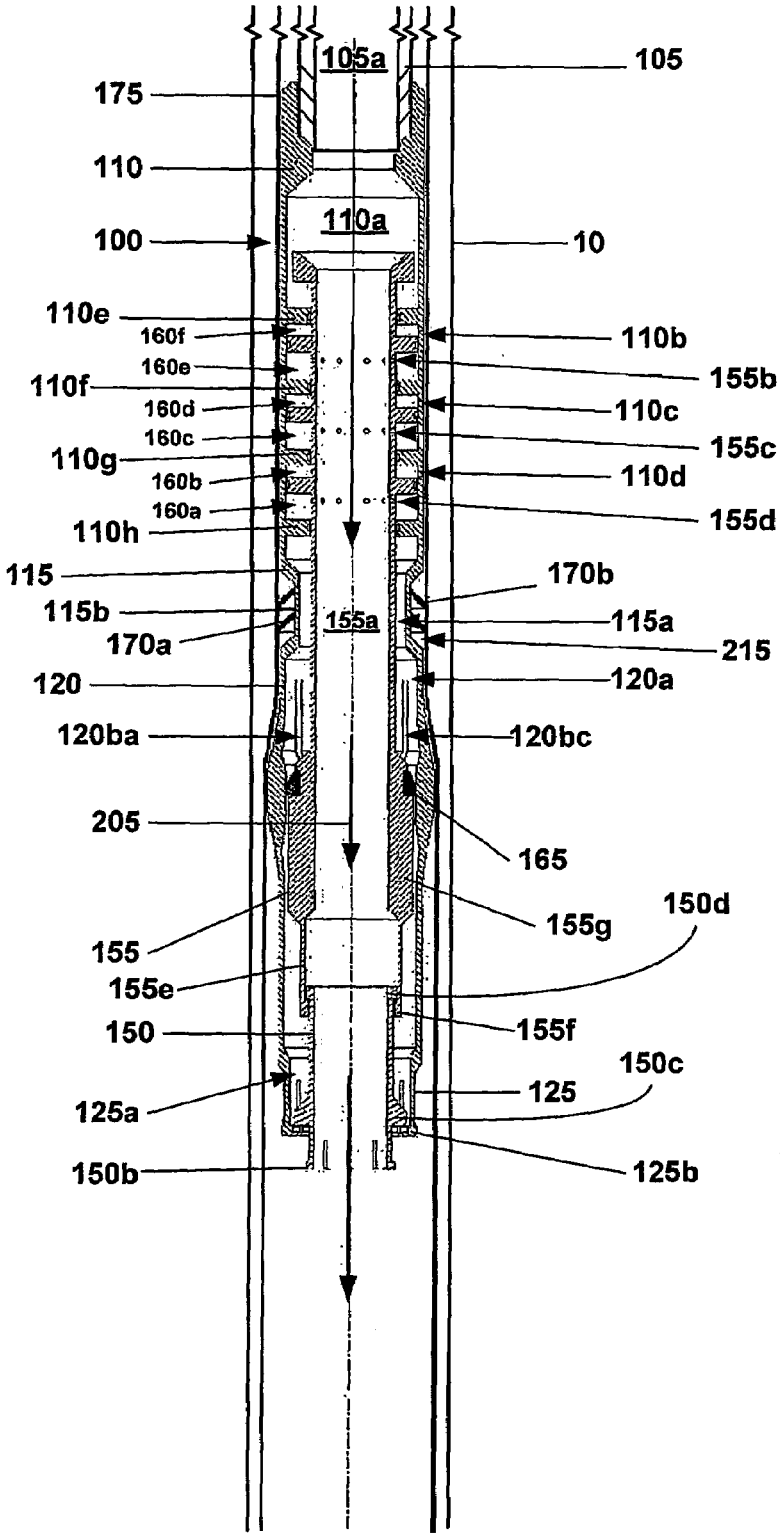
FIG. 7 is a fragmentary cross-sectional illustration of the apparatus of FIG. 6 after continuing to inject a fluidic material into the apparatus thereby continuing to displace the tubular support members, the tubular locking collet, the tubular locking sleeve, and the tubular tension sleeve upwardly in the axial direction thereby further plastically deforming and radially expanding the expandable tubular member.

As illustrated in FIG. 7, continued injection of the fluidic material 205 may further pressurize the passages 105*a*, 110*a*, and 155*a*. As a result, the tubular support members 105, 110, 115, and 120, the tubular locking collet 125, the tubular locking sleeve 150, and the tubular tension sleeve 155 may be further displaced upwardly in the axial direction thereby further plastically deforming and radially expanding the expandable tubular member 175. Furthermore, during the continued injection of the fluidic material 205, an annular region 215 between the tubular support member 120 and the expandable tubular member 175 below the sealing cups, 170*a* and 170*b*, may be pressurized thereby facilitating the upward axial displacement of the tubular support members 105, 110, 115, and 120, the tubular locking collet 125, the tubular locking sleeve 150, and the tubular tension sleeve 155.

In several alternative embodiments, the design and operation of the apparatus 100 is further provided substantially as disclosed in one or more of the following: (1) U.S. patent application Ser. No. 09/454,139, filed on Dec. 3, 1999, (2) U.S. patent application Ser. No. 09/510,913, filed on Feb. 23, 2000, (3) U.S. patent application Ser. No. 09/502,350, filed on Feb. 10, 2000, (4) U.S. patent application Ser. No. 09/440,338, filed on Nov. 15, 1999, (5) U.S. patent application Ser. No. 09/523,460, filed on Mar. 10, 2000, (6) U.S. patent application Ser. No. 09/512,895, filed on Feb. 24, 2000, (7) U.S. patent application Ser. No. 09/511,941, filed on Feb. 24, 2000, (8) U.S. patent application Ser. No. 09/588,946, filed on Jun. 7, 2000, (9) U.S. patent application Ser. No. 09/559,122, filed on Apr. 26, 2000, (10) PCT patent application Ser. No. PCT/US00/18635, filed on Jun. 9, 2000, (11) U.S. provisional patent application Ser. No. 60/162,671, filed on Nov. 1, 1999, (12) U.S. provisional patent application Ser. No. 60/154,047, 25791.29, filed on Sep. 16, 1999, (13) U.S. provisional patent application Ser. No. 60/159,082, filed on Oct. 12, 1999, (14) U.S. provisional patent application Ser. No. 60/159,039, filed on Oct. 12, 1999, (15) U.S. provisional patent application Ser. No. 60/159,033, filed on Oct. 12, 1999, (16) U.S. provisional patent application Ser. No. 60/212,359, filed on Jun. 19, 2000, (17) U.S. provisional patent application Ser. No. 60/165,228, filed on Nov. 12, 1999, (18) U.S. provisional patent application Ser. No. 60/221,443, filed on Jul. 28, 2000, (19) U.S. provisional patent application Ser. No. 60/221,645, filed on Jul. 28, 2000, (20) U.S. provisional patent application Ser. No. 60/233,638, filed on Sep. 18, 2000, (21) U.S. provisional patent application Ser. No. 60/237,334, filed on Oct. 2, 2000, (22) U.S. provisional patent application Ser. No. 60/270,007, filed on Feb. 20, 2001; (23) U.S. provisional patent application Ser. No. 60/262,434, filed on Jan. 17, 2001; (24) U.S, provisional patent application Ser. No. 60/259,486, filed on Jan. 3, 2001; and (25) U.S. provisional patent application Ser. No. 60/303,740, filed on Jul. 6, 2001, the disclosures of which are incorporated herein by reference.

In several alternative embodiments, the apparatus 100 may be operated for form or repair a wellbore casing, a pipeline, or a structural support.

An apparatus for forming a wellbore casing within a wellbore within a subterranean formation has been described that includes a tubular support member, an adjustable tubular expansion cone coupled to the tubular support member, an actuator coupled to the tubular support member for adjusting the size of the adjustable tubular expansion cone, a shoe releasably coupled to the adjustable tubular expansion cone, an expandable tubular member coupled to the shoe defining a longitudinal passage for receiving the tubular support member, the adjustable tubular expansion cone, and the actuator, and one or more sealing members for sealing the interface between the tubular support member and the expandable tubular member. In an exemplary embodiment, the adjustable tubular expansion cone includes a tubular body defining a plurality of longitudinal slots and comprising a plurality of internal arcuate expansion cone segments interleaved among the longitudinal slots. In an exemplary embodiment, the actuator includes a first tubular member coupled to the tubular support member defining a plurality of first radial passage and including a plurality of internal flanges interleaved among the first radial passages, a second tubular member received within the first tubular member defining a plurality of second radial passages interleaved among the first radial passages and comprising a plurality of external flanges interleaved among the first and second radial passages and the internal flanges, and a tubular expansion cone coupled to the second tubular member for radially expanding the adjustable tubular expansion cone.

A method of forming a wellbore casing within a wellbore within a subterranean formation has also been described that includes positioning an expandable tubular member and an adjustable tubular expansion cone within the wellbore, increasing the size of the adjustable tubular expansion cone within the expandable tubular member, and plastically deforming and radially expanding the expandable tubular member using the adjustable tubular expansion cone. In an exemplary embodiment, the increasing the size of the adjustable tubular expansion cone within the expandable tubular member includes positioning a tubular segmented expansion cone within the expandable tubular member, positioning a tubular expansion cone within the expandable tubular member, and displacing the tubular expansion cone relative to the tubular segmented expansion cone.

An apparatus for forming a wellbore casing within a wellbore within a subterranean formation has also been described that includes means for positioning an expandable tubular member and an adjustable tubular expansion cone within the wellbore, means for increasing the size of the adjustable tubular expansion cone within the expandable tubular member, and means for plastically deforming and radially expanding the expandable tubular member using the adjustable tubular expansion cone. In an exemplary embodiment, the means for increasing the size of the adjustable tubular expansion cone within the expandable tubular member includes means for positioning a tubular segmented expansion cone within the expandable tubular member, means for positioning a tubular expansion cone within the expandable tubular member, and means for displacing the tubular expansion cone relative to the tubular segmented expansion cone.

An adjustable expansion cone for plastically deforming and radially expanding a tubular member has also been described that includes an adjustable tubular expansion cone, and an actuator for adjusting the tubular adjustable expansion cone. In an exemplary embodiment, the adjustable tubular expansion cone includes a tubular body defining a plurality of longitudinal slots and comprising a plurality of internal arcuate conical expansion cone segments interleaved among the longitudinal slots. In an exemplary embodiment, the actuator includes a first tubular member coupled to the adjustable tubular expansion cone defining a plurality of first radial passage and comprising a plurality of internal flanges interleaved among the first radial passages, a second tubular member received within the first tubular member defining a plurality of second radial passages interleaved among the first radial passages and comprising a plurality of external flanges interleaved among the first and second radial passages and the internal flanges, and a tubular expansion cone coupled to the second tubular member for radially expanding the tubular adjustable expansion cone.

A method of plastically deforming and radially expanding a tubular member has also been described that includes positioning an adjustable tubular expansion cone within the tubular member, and increasing the size of the adjustable tubular expansion cone within the expandable tubular member. In an exemplary embodiment, increasing the size of the adjustable tubular expansion cone within the tubular member includes positioning a tubular segmented expansion cone within the tubular member, positioning a tubular expansion cone within the tubular member, and displacing the tubular expansion cone relative to the tubular segmented expansion cone.

An apparatus for plastically deforming and radially expanding a tubular member has also been described that includes means for positioning an adjustable tubular expansion cone within the tubular member, and means for increasing the size of the adjustable tubular expansion cone within the expandable tubular member. In an exemplary embodiment, the means for increasing the size of the adjustable tubular expansion cone within the tubular member includes means for positioning a tubular segmented expansion cone within the tubular member, means for positioning a tubular expansion cone within the tubular member, and means for displacing the tubular expansion cone relative to the tubular segmented expansion cone.

A tubular member has also been described that includes a tubular body defining a plurality of longitudinal slots, and a plurality of arcuate internal flanges. Each flange includes an arcuate cylindrical segment end face, trapezoidal side faces, an upper inclined trapezoidal side face, and a lower inclined trapezoidal side face.

An apparatus for forming a wellbore casing within a wellbore within a subterranean formation has been described that includes a tubular support member, an adjustable expansion device coupled to the tubular support member, an actuator coupled to the tubular support member for adjusting the size of the adjustable expansion device, an expandable tubular member coupled to the tubular support member defining a longitudinal passage for receiving the tubular support member, the adjustable expansion device, and the actuator, and one or more sealing members for sealing the interface between the tubular support member and the expandable tubular member. In an exemplary embodiment, the adjustable expansion device comprises a tubular body defining a plurality of longitudinal slots and comprising a plurality of internal arcuate expansion segments interleaved among the longitudinal slots. In an exemplary embodiment, the actuator comprises a first tubular member coupled to the tubular support member defining a plurality of first radial passage and comprising a plurality of internal flanges interleaved among the first radial passages, a second tubular member received within the first tubular member defining a plurality of second radial passages interleaved among the first radial passages and comprising a plurality of external flanges interleaved among the first and second radial passages and the internal flanges, and an expansion device coupled to the second tubular member for radially expanding the adjustable expansion device.

A method of forming a wellbore casing within a wellbore within a subterranean formation has been described that includes positioning an expandable tubular member and an adjustable expansion device within the wellbore, increasing the size of the adjustable expansion device within the expandable tubular member, and plastically deforming and radially expanding the expandable tubular member using the adjustable expansion device. In an exemplary embodiment, increasing the size of the adjustable expansion device within the expandable tubular member comprises positioning a segmented expansion device within the expandable tubular member, positioning an expansion device within the expandable tubular member, and displacing the expansion device relative to the segmented expansion device.

An apparatus for forming a wellbore casing within a wellbore within a subterranean formation has been described that includes means for positioning an expandable tubular member and an adjustable expansion device within the wellbore, means for increasing the size of the adjustable expansion device within the expandable tubular member, and means for plastically deforming and radially expanding the expandable tubular member using the adjustable expansion device. In an exemplary embodiment, the means for increasing the size of the adjustable expansion device within the expandable tubular member comprises means for positioning a segmented expansion device within the expandable tubular member, means for positioning an expansion device within the expandable tubular member, and means for displacing the expansion device relative to the segmented expansion device.

An adjustable expansion device for plastically deforming and radially expanding a tubular member has been described that includes an adjustable tubular expansion device, and an actuator for adjusting the tubular adjustable tubular expansion device. In an exemplary embodiment, the adjustable tubular expansion device comprises a tubular body defining a plurality of longitudinal slots and comprising a plurality of internal arcuate expansion segments interleaved among the longitudinal slots. In an exemplary embodiment, the actuator comprises a first tubular member coupled to the adjustable expansion device defining a plurality of first radial passage and comprising a plurality of internal flanges interleaved among the first radial passages, a second tubular member received within the first tubular member defining a plurality of second radial passages interleaved among the first radial passages and comprising a plurality of external flanges interleaved among the first and second radial passages and the internal flanges, and an expansion device to the second tubular member for radially expanding the tubular adjustable expansion device.

A method of plastically deforming and radially expanding a tubular member has been described that includes positioning an adjustable expansion device within the tubular member, and increasing the size of the adjustable expansion device within the expandable tubular member. In an exemplary embodiment, increasing the size of the adjustable expansion device within the tubular member comprises positioning a segmented expansion device within the tubular member, positioning an expansion device within the tubular member, and displacing the expansion device relative to the segmented expansion device.

An apparatus for plastically deforming and radially expanding a tubular member has been described that includes means for positioning an adjustable expansion device within the tubular member, and means for increasing the size of the adjustable expansion device within the expandable tubular member. In an exemplary embodiment, the means for increasing the size of the adjustable expansion device within the tubular member comprises means for positioning a segmented expansion device within the tubular member, means for positioning an expansion device within the tubular member, and means for displacing the expansion device relative to the segmented expansion device.

An apparatus for forming a wellbore casing within a wellbore within a subterranean formation has been described that includes a tubular support member, an adjustable expansion device coupled to the tubular support member, comprising a body defining a plurality of longitudinal slots and comprising a plurality of internal expansion segments interleaved among the longitudinal slots, an actuator coupled to the tubular support member for adjusting the size of the adjustable expansion device, comprising: a first tubular member coupled to the tubular support member defining a plurality of first radial passage and comprising a plurality of internal flanges interleaved among the first radial passages, a second tubular member received within the first tubular member defining a plurality of second radial passages interleaved among the first radial passages and comprising a plurality of external flanges interleaved among the first and second radial passages and the internal flanges, and an expansion device coupled to the second tubular member for radially expanding the adjustable expansion device, a shoe releasably coupled to the adjustable expansion device, an expandable tubular member coupled to the shoe defining a longitudinal passage for receiving the tubular support member, the adjustable expansion device, and the actuator, and one or more sealing members for sealing the interface between the tubular support member and the expandable tubular member.

A method of forming a wellbore casing within a wellbore within a subterranean formation has been described that includes positioning an expandable tubular member and an adjustable expansion device within the wellbore, increasing the size of the adjustable expansion device within the expandable tubular member, comprising: positioning a segmented expansion device within the expandable tubular member, positioning an expansion device within the expandable tubular member, and displacing the expansion device relative to the segmented expansion device, and plastically deforming and radially expanding the expandable tubular member using the adjustable expansion device.

An apparatus for forming a wellbore casing within a wellbore within a subterranean formation has been described that includes means for positioning an expandable tubular member and an adjustable expansion device within the wellbore, means for increasing the size of the adjustable expansion device within the expandable tubular member, comprising means for positioning a segmented expansion device within the expandable tubular member, means for positioning an expansion device within the expandable tubular member, and means for displacing the expansion device relative to the segmented expansion device, and means for plastically deforming and radially expanding the expandable tubular member using the adjustable expansion device.

An adjustable expansion device for plastically deforming and radially expanding a tubular member has been described that includes an adjustable tubular expansion device, comprising: a tubular body defining a plurality of longitudinal slots and comprising a plurality of internal expansion segments interleaved among the longitudinal slots, and an actuator for adjusting the adjustable tubular expansion device, comprising: a first tubular member coupled to the adjustable tubular expansion device defining a plurality of first radial passage and comprising a plurality of internal flanges interleaved among the first radial passages, a second tubular member received within the first tubular member defining a plurality of second radial passages interleaved among the first radial passages and comprising a plurality of external flanges interleaved among the first and second radial passages and the internal flanges, and an expansion device coupled to the second tubular member for radially expanding the adjustable tubular expansion device.

A method of plastically deforming and radially expanding a tubular member has been described that includes positioning an adjustable tubular expansion device within the tubular member, and increasing the size of the adjustable tubular expansion device within the expandable tubular member, comprising: positioning a tubular segmented expansion device within the tubular member, positioning an expansion device within the tubular member, and displacing the expansion device relative to the segmented expansion device.

An apparatus for plastically deforming and radially expanding a tubular member has been described that includes means for positioning an adjustable expansion device within the tubular member, and means for increasing the size of the adjustable expansion device within the expandable tubular member, comprising: means for positioning a segmented expansion device within the tubular member, means for positioning an expansion device within the tubular member, and means for displacing the expansion device relative to the segmented expansion device.

A method of radially expanding and plastically deforming a tubular member has been described that includes positioning an adjustable expansion device within the tubular member, adjusting a size of the adjustable expansion device within the tubular member, and displacing the adjustable expansion device relative to the tubular member by pulling the adjustable expansion device through the tubular member using fluid pressure.

A system for radially expanding and plastically deforming a tubular member has been described that includes means for positioning an adjustable expansion device within the tubular member, means for adjusting a size of the adjustable expansion device within the tubular member, and means for displacing the adjustable expansion device relative to the tubular member by pulling the adjustable expansion device through the tubular member using fluid pressure.

A method of radially expanding and plastically deforming a tubular member has been described that includes positioning an expansion device within the tubular member, and displacing the expansion device relative to the tubular member by pulling the expansion device through the tubular member using fluid pressure.

A system for radially expanding and plastically deforming a tubular member has been described that includes means for positioning an expansion device within the tubular member, and means for displacing the expansion device relative to the tubular member by pulling the expansion device through the tubular member using fluid pressure.

It is understood that variations may be made in the foregoing without departing from the scope of the invention. For example, a conventional packer assembly may be substituted for the shoe 135.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. An apparatus for forming a wellbore casing within a wellbore within a subterranean formation, comprising;

a tubular support member;

an adjustable tubular expansion cone coupled to the tubular support member;

an actuator coupled to the tubular support member for adjusting the size of the adjustable tubular expansion cone;

a shoe releasably coupled to the adjustable tubular expansion cone;

an expandable tubular member coupled to the shoe defining a longitudinal passage for receiving the tubular support member, the adjustable tubular expansion cone, and the actuator; and one or more sealing members for sealing the interface between the tubular support member and the expandable tubular member.

2. The apparatus of claim 1, wherein the adjustable tubular expansion cone comprises;

a tubular body defining a plurality of longitudinal slots and comprising a plurality of internal arcuate expansion cone segments interleaved among the longitudinal slots.

3. The apparatus of claim 1, wherein the actuator comprises;

a first tubular member coupled to the tubular support member defining a plurality of first radial passage and comprising a plurality of internal flanges interleaved among the first radial passages;

a second tubular member received within the first tubular member defining a plurality of second radial passages interleaved among the first radial passages and comprising a plurality of external flanges interleaved among the first and second radial passages and the internal flanges; and a tubular expansion cone coupled to the second tubular member for radially expanding the adjustable tubular expansion cone.

4. A method of forming a wellbore casing within a wellbore within a subterranean formation, comprising;

positioning an expandable tubular member and an adjustable tubular expansion cone within the wellbore;

increasing the size of the adjustable tubular expansion cone within the expandable tubular member;

plastically deforming and radially expanding the expandable tubular member using the adjustable tubular expansion cone;

wherein increasing the size of the adjustable tubular expansion cone within the expandable tubular member comprises;

positioning a tubular segmented expansion cone within the expandable tubular member;

positioning a tubular expansion cone within the expandable tubular member; and displacing the tubular expansion cone relative to the tubular segmented expansion cone.

5. An apparatus for forming a wellbore casing within a wellbore within a subterranean formation, comprising;

means for positioning an expandable tubular member and an adjustable tubular expansion cone within the wellbore;

means for increasing the size of the adjustable tubular expansion cone within the expandable tubular member;

means for plastically deforming and radially expanding the expandable tubular member using the adjustable tubular expansion cone;

wherein the means for increasing the size of the adjustable tubular expansion cone within the expandable tubular member comprises;

means for positioning a tubular segmented expansion cone within the expandable tubular member;

means for positioning a tubular expansion cone within the expandable tubular member; and means for displacing the tubular expansion cone relative to the tubular segmented expansion cone.

6. An adjustable expansion cone for plastically deforming and radially expanding a tubular member, comprising;

an adjustable tubular expansion cone;

an actuator for adjusting the adjustable tubular expansion cone;

Wherein the adjustable tubular expansion cone comprises;

a tubular body defining a plurality of longitudinal slots and comprising a plurality of internal arcuate conical expansion cone segments interleaved among the longitudinal slots.

7. An adjustable expansion cone for plastically deforming and radially expanding a tubular member, comprising;

an adjustable tubular expansion cone;

an actuator for adjusting the adjustable tubular expansion cone;

wherein the actuator comprises;

a first tubular member coupled to the adjustable tubular expansion cone defining a plurality of first radial passage and comprising a plurality of internal flanges interleaved among the first radial passages;

a second tubular member received within the first tubular member defining a plurality of second radial passages interleaved among the first radial passages and comprising a plurality of external flanges interleaved among the first and second radial passages and the internal flanges; and a tubular expansion cone coupled to the second tubular member for radially expanding the tubular adjustable expansion cone.

8. A method of plastically deforming and radially expanding a tubular member, comprising;

positioning an adjustable tubular expansion cone within the tubular member;

increasing the size of the adjustable tubular expansion cone within the expandable tubular member;

wherein increasing the size of the adjustable tubular expansion cone within the tubular member comprises;

positioning a tubular segmented expansion cone within the tubular member;

positioning a tubular expansion cone within the tubular member; and displacing the tubular expansion cone relative to the tubular segmented expansion cone.

9. An apparatus for plastically deforming and radially expanding a tubular member, comprising;

means for positioning an adjustable tubular expansion cone within the tubular member; and means for increasing the size of the adjustable tubular expansion cone within the expandable tubular member;

wherein the means for increasing the size of the adjustable tubular expansion cone within the tubular member comprises;

means for positioning a tubular segmented expansion cone within the tubular member;

means for positioning a tubular expansion cone within the tubular member; and means for displacing the tubular expansion cone relative to the tubular segmented expansion cone.

10. A tubular member, comprising;

a tubular body defining a plurality of longitudinal slots; and a plurality of arcuate internal flanges, each flange comprising;

an arcuate cylindrical segment end face;

trapezoidal side faces;

an upper inclined trapezoidal side face; and a lower inclined trapezoidal side face.

11. An apparatus for forming a wellbore casing within a wellbore within a subterranean formation, comprising;

a tubular support member;

an adjustable tubular expansion cone coupled to the tubular support member, comprising;

a tubular body defining a plurality of longitudinal slots and comprising a plurality of internal arcuate expansion cone segments interleaved among the longitudinal slots;

an actuator coupled to the tubular support member for adjusting the size of the adjustable tubular expansion cone, comprising;

a first tubular member coupled to the tubular support member defining a plurality of first radial passage and comprising a plurality of internal flanges interleaved among the first radial passages;

a second tubular member received within the first tubular member defining a plurality of second radial passages interleaved among the first radial passages and comprising a plurality of external flanges interleaved among the first and second radial passages and the internal flanges; and a tubular expansion cone coupled to the second tubular member for radially expanding the adjustable tubular expansion cone;

a shoe releasably coupled to the adjustable tubular expansion cone;

an expandable tubular member coupled to the shoe defining a longitudinal passage for receiving the tubular support member, the adjustable tubular expansion cone, and the actuator; and one or more sealing members for sealing the interface between the tubular support member and the expandable tubular member.

12. A method of forming a wellbore casing within a wellbore within a subterranean formation, comprising;

positioning an expandable tubular member and an adjustable tubular expansion cone within the wellbore;

increasing the size of the adjustable tubular expansion cone within the expandable tubular member, comprising;

positioning a tubular segmented expansion cone within the expandable tubular member;

positioning a tubular expansion cone within the expandable tubular member; and displacing the tubular expansion cone relative to the tubular segmented expansion cone; and plastically deforming and radially expanding the expandable tubular member using the adjustable tubular expansion cone.

13. An apparatus for forming a wellbore casing within a wellbore within a subterranean formation, comprising;

means for positioning an expandable tubular member and an adjustable tubular expansion cone within the wellbore;

means for increasing the size of the adjustable tubular expansion cone within the expandable tubular member, comprising;

means for positioning a tubular segmented expansion cone within the expandable tubular member;

means for positioning a tubular expansion cone within the expandable tubular member; and means for displacing the tubular expansion cone relative to the tubular segmented expansion cone; and means for plastically deforming and radially expanding the expandable tubular member using the adjustable tubular expansion cone.

14. An adjustable expansion cone for plastically deforming and radially expanding a tubular member, comprising;

an adjustable tubular expansion cone, comprising;

a tubular body defining a plurality of longitudinal slots and comprising a plurality of internal arcuate conical expansion cone segments interleaved among the longitudinal slots; and an actuator for adjusting the tubular adjustable expansion cone, comprising;

a first tubular member coupled to the adjustable tubular expansion cone defining a plurality of first radial passage and comprising a plurality of internal flanges interleaved among the first radial passages;

a second tubular member received within the first tubular member defining a plurality of second radial passages interleaved among the first radial passages and comprising a plurality of external flanges interleaved among the first and second radial passages and the internal flanges; and a tubular expansion cone coupled to the second tubular member for radially expanding the tubular adjustable expansion cone.

15. An apparatus for forming a wellbore casing within a wellbore within a subterranean formation, comprising;

a tubular support member;

an adjustable expansion device coupled to the tubular support member;

an actuator coupled to the tubular support member for adjusting the size of the adjustable expansion device;

an expandable tubular member coupled to the tubular support member defining a longitudinal passage for receiving the tubular support member, the adjustable expansion device, and the actuator; and one or more sealing members for sealing the interface between the tubular support member and the expandable tubular member.

16. The apparatus of claim 15, wherein the adjustable expansion device comprises;

a tubular body defining a plurality of longitudinal slots and comprising a plurality of internal arcuate expansion segments interleaved among the longitudinal slots.

17. The apparatus of claim 15, wherein the actuator comprises;

a first tubular member coupled to the tubular support member defining a plurality of first radial passage and comprising a plurality of internal flanges interleaved among the first radial passages;

a second tubular member received within the first tubular member defining a plurality of second radial passages interleaved among the first radial passages and comprising a plurality of external flanges interleaved among the first and second radial passages and the internal flanges; and an expansion device coupled to the second tubular member for radially expanding the adjustable expansion device.

18. An adjustable expansion device for plastically deforming and radially expanding a tubular member, comprising;

an adjustable tubular expansion device, the adjustable expansion device comprising a tubular segmented expansion cone and an adjustable tubular expansion an actuator for adjusting the tubular adjustable tubular expansion device;

wherein the adjustable tubular expansion device comprises;

a tubular body defining a plurality of longitudinal slots and comprising a plurality of internal arcuate expansion segments interleaved among the longitudinal slots.

19. An adjustable expansion device for plastically deforming and radially expanding a tubular member, comprising;

an adjustable tubular expansion device, the adjustable expansion device comprising a tubular segmented expansion cone and an adjustable tubular expansion an actuator for adjusting the tubular adjustable tubular expansion device;

wherein the actuator comprises;

a first tubular member coupled to the adjustable expansion device defining a plurality of first radial passage and comprising a plurality of internal flanges interleaved among the first radial passages;

a second tubular member received within the first tubular member defining a plurality of second radial passages interleaved among the first radial passages and comprising a plurality of external flanges interleaved among the first and second radial passages and the internal flanges; and an expansion device to the second tubular member for radially expanding the tubular adjustable expansion device.

20. An apparatus for forming a wellbore casing within a wellbore within a subterranean formation, comprising;

a tubular support member;

an adjustable expansion device coupled to the tubular support member, comprising;

a body defining a plurality of longitudinal slots and comprising a plurality of internal expansion segments interleaved among the longitudinal slots;

an actuator coupled to the tubular support member for adjusting the size of the adjustable expansion device, comprising;

a first tubular member coupled to the tubular support member defining a plurality of first radial passage and comprising a plurality of internal flanges interleaved among the first radial passages;

a second tubular member received within the first tubular member defining a plurality of second radial passages interleaved among the first radial passages and comprising a plurality of external flanges interleaved among the first and second radial passages and the internal flanges; and an expansion device coupled to the second tubular member for radially expanding the adjustable expansion device;

a shoe releasably coupled to the adjustable expansion device;

an expandable tubular member coupled to the shoe defining a longitudinal passage for receiving the tubular support member, the adjustable expansion device, and the actuator; and one or more sealing members for sealing the interface between the tubular support member and the expandable tubular member.

21. A method of forming a wellbore casing within a wellbore within a subterranean formation, comprising;

positioning an expandable tubular member and an adjustable expansion device within the wellbore;

increasing the size of the adjustable expansion device within the expandable tubular member, comprising;

positioning a segmented expansion device within the expandable tubular member;

positioning an expansion device within the expandable tubular member; and displacing the expansion device relative to the segmented expansion device; and plastically deforming and radially expanding the expandable tubular member using the adjustable expansion device.

22. An apparatus for forming a wellbore casing within a wellbore within a subterranean formation, comprising;

means for positioning an expandable tubular member and an adjustable expansion device within the wellbore;

means for increasing the size of the adjustable expansion device within the expandable tubular member, comprising;

means for positioning a segmented expansion device within the expandable tubular member;

means for positioning an expansion device within the expandable tubular member; and means for displacing the expansion device relative to the segmented expansion device; and means for plastically deforming and radially expanding the expandable tubular member using the adjustable expansion device.

23. An adjustable expansion device for plastically deforming and radially expanding a tubular member, comprising;

an adjustable tubular expansion device, comprising;

a tubular body defining a plurality of longitudinal slots and comprising a plurality of internal expansion segments interleaved among the longitudinal slots; and an actuator for adjusting the adjustable tubular expansion device, comprising;

a first tubular member coupled to the adjustable tubular expansion device defining a plurality of first radial passage and comprising a plurality of internal flanges interleaved among the first radial passages;

a second tubular member received within the first tubular member defining a plurality of second radial passages interleaved among the first radial passages and comprising a plurality of external flanges interleaved among the first and second radial passages and the internal flanges; and an expansion device coupled to the second tubular member for radially expanding the adjustable tubular expansion device.

* * * * *